US012031265B2

(12) United States Patent
Kang et al.

(10) Patent No.: US 12,031,265 B2
(45) **Date of Patent: *Jul. 9, 2024**

(54) CLOTHES TREATMENT APPARATUS

(71) Applicant: LG ELECTRONICS INC., Seoul (KR)

(72) Inventors: Hyungha Kang, Seoul (KR); Jaehyung Kim, Seoul (KR); Semin Jang, Seoul (KR); Joosik Jung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

This patent is subject to a terminal disclaimer.

(21) Appl. No.: 18/091,659

(22) Filed: Dec. 30, 2022

(65) Prior Publication Data

US 2023/0138542 A1 May 4, 2023

Related U.S. Application Data

(63) Continuation of application No. 16/957,866, filed as application No. PCT/KR2018/001555 on Dec. 7, 2018, now Pat. No. 11,686,039.

(30) Foreign Application Priority Data

Dec. 8, 2017 (KR) ..... 10-2017-0168514
Dec. 8, 2017 (KR) ..... 10-2018-0148692

(51) Int. Cl.
*D06F 58/12* (2006.01)
*D06F 58/20* (2006.01)
*D06F 73/02* (2006.01)

(52) U.S. Cl.
CPC ..... *D06F 58/12* (2013.01); *D06F 58/20* (2013.01); *D06F 73/02* (2013.01)

(58) Field of Classification Search
CPC ..... D06F 58/12; D06F 58/20; D06F 58/10; D06F 73/02; D06F 73/00; B06B 1/14; B06B 1/10; B06B 1/12; B06B 1/16
See application file for complete search history.

(56) References Cited

U.S. PATENT DOCUMENTS 2,206,386 A 7/1940 Bernhard
4,942,776 A * 7/1990 Quirk ..... F16H 57/0006 74/DIG. 10

(Continued)

FOREIGN PATENT DOCUMENTS

CN 1814894 A 8/2006
CN 101997357 A 3/2011

(Continued)

OTHER PUBLICATIONS

Australian Examination Report issued in Application No. 2018380777 dated Feb. 26, 2021 (7 pages).

(Continued)

*Primary Examiner* — Ismael Izaguirre
(74) *Attorney, Agent, or Firm* — Birch, Stewart, Kolasch & Birch, LLP

(57) ABSTRACT

A clothes treatment apparatus for treating clothes in a treatment space including a frame, a hanger body movable with respect to the frame, a center axial portion fixed with respect to the frame, and disposed along a center axis extending in the vertical direction, a first eccentric portion configured to rotate in a first direction around a first rotational axis spaced apart from the center axis, a second eccentric portion configured to rotate in a second direction opposite to the first direction around the first rotational axis, a motor generating a torque for rotating the first eccentric portion and second eccentric portion, a vibrating body supporting rotatably the first eccentric portion and second eccentric portion, and a hanger driving unit connecting the (Continued)

vibrating body and the hanger body. The hanger driving unit transmitting excitation force of the vibrating body to the hanger body.

20 Claims, 18 Drawing Sheets

(56) References Cited

U.S. PATENT DOCUMENTS

| | | | | |
|---|---|---|---|---|
| 5,134,893 | A * | 8/1992 | Hukki | B06B 1/163 74/61 |
| 8,539,694 | B2 | 9/2013 | Moon et al. | |
| 9,359,710 | B2 * | 6/2016 | Lee | D06F 58/12 |
| 11,414,810 | B2 | 8/2022 | Kim et al. | |
| 2003/0223309 | A1 | 12/2003 | Hapke | |
| 2005/0035076 | A1 | 2/2005 | Schober et al. | |
| 2006/0037209 | A1 | 2/2006 | Johnson et al. | |
| 2010/0043500 | A1 | 2/2010 | Yoo et al. | |
| 2010/0146805 | A1 * | 6/2010 | Kim | F26B 11/12 34/201 |
| 2012/0232780 | A1 | 9/2012 | Delson et al. | |
| 2017/0350066 | A1 | 12/2017 | Kim | |
| 2021/0372030 | A1 | 12/2021 | Kang et al. | |

FOREIGN PATENT DOCUMENTS

| | | | |
|---|---|---|---|
| CN | 102131978 | A | 7/2011 |
| CN | 102282309 | A | 12/2011 |
| CN | 103510357 | A | 1/2014 |
| CN | 103620928 | A | 3/2014 |
| EP | 0 473 449 | A1 | 3/1992 |
| EP | 1 867 402 | A1 | 12/2007 |
| EP | 2 385 168 | A2 | 11/2011 |
| KR | 10-0166924 | B1 | 6/1997 |
| KR | 10-2010-0022382 | A | 3/2010 |
| KR | 10-2010-0066176 | A | 6/2010 |
| KR | 10-2010-0073142 | A | 7/2010 |
| KR | 10-2014-0108454 | A | 9/2014 |
| KR | 10-2014-0108455 | A | 9/2014 |
| KR | 10-2014-0112386 | A | 9/2014 |
| SU | 1442582 | A1 | 12/1998 |
| WO | WO 2015/126073 | A1 | 8/2015 |
| WO | WO 2015/180473 | A1 | 12/2015 |

OTHER PUBLICATIONS

Communication and Search Report issued in EP Application No. 18885041.6, dated Aug. 16, 2021 (9 pages).

International Search Report and Written Opinion dated Mar. 4, 2019 in International Application No. PCT/KR2018/015555 (19 pgs.).

Notice of Allowance issued in Korean Application No. 10-2018-0148692, dated Jun. 30, 2021 (1 page).

Russian Notice of Allowance dated Nov. 25, 2020 in Application No. 2020122219 (11 pages).

* cited by examiner

CLOTHES TREATMENT APPARATUS

CROSS-REFERENCES TO RELATED APPLICATIONS

This application is a Continuation of U.S. application Ser. No. 16/957,866, filed Jun. 25, 2020, which is a national stage entry under 35 U.S.C. § 371 based on International Application No. PCT/KR2018/015555, filed Dec. 7, 2018, which claims priority to Korean Patent Application No. 10-2017-0168514, filed Dec. 8, 2017, and Korean Patent Application No. 10-2018-0148692, filed Dec. 8, 2017, the contents of each of the aforementioned applications are incorporated herein by reference in their entirety.

BACKGROUND

Technical Field

The present disclosure relates to a structure for vibrating clothes in a clothes treatment apparatus.

Discussion of the Related Art

A clothes treatment apparatus refers to all kinds of apparatuses for maintaining or treating clothes, such washing, drying, and dewrinkling them, at home or at a laundromat. Examples of clothes treatment apparatuses include a washer for washing clothes, a dryer for drying clothes, a washer-dryer which performs both washing and drying functions, a refresher for refreshing clothes, and a steamer for removing unnecessary wrinkles in clothes.

More specifically, the refresher is a device used for keeping clothes crisp and fresh, which performs functions like drying clothes, providing fragrance to clothes, preventing static cling on clothes, removing wrinkles from clothes, and so on. The steamer is generally a device that provides steam to clothes to remove wrinkles from them, which can remove wrinkles from clothes in a more delicate way, without the hot plate touching the clothes like in traditional irons. There is a known clothes treatment apparatus equipped with both the refresher and steamer functions, that functions to remove wrinkles and smells from clothes put inside it by using steam and hot air.

There is also a known clothes treatment apparatus that functions to smooth out wrinkles in clothes by vibrating (reciprocating) a hanging bar for clothes in a predetermined direction.

Technical Problem

A problem with the conventional art is that unnecessary vibrations occur in other directions than the direction of vibration when the hanging bar is vibrated. A first aspect of the present disclosure is to minimize unnecessary vibrations by solving this problem.

A second aspect of the present disclosure is to minimize unnecessary vibrations and efficiently increase the excitation force in the direction of vibration applied to the hanging bar.

Another problem with the conventional art is that amplitude is maintained even if the vibration frequency of the hanging bar is changed, thus putting stress on items. A third aspect of the present disclosure is reduce the stress on items caused by a change of frequency by solving this problem.

A fourth aspect of the present disclosure is to allow the hanging bar to move in a vibrating motion by adjusting it to various vibration frequencies and amplitudes when the hanging bar vibrates.

SUMMARY OF THE INVENTION

In order to address the aforementioned aspects, a clothes treatment apparatus according to an exemplary embodiment of the present disclosure comprises: a frame; a hanger body configured to move with respect to the frame and provided to hang clothes or clothes hangers; a vibrating body configured to move with respect to the frame; a first eccentric portion that is supported by the vibrating body and rotates around a predetermined first rotational axis in such a way that the weight is off-center; a second eccentric portion that is supported by the vibrating body and rotates around a predetermined second rotational axis, which is the same as or parallel to the first rotational axis, in such a way that the weight is off-center; and a hanger driving unit that connects the vibrating body and the hanger body and transmits the vibration of the vibrating body to the hanger body, wherein the first eccentric portion and the second eccentric portion are configured to rotate at the same angular speed but in opposite directions.

In order to address the aforementioned aspects, a clothes treatment apparatus according to an exemplary embodiment of the present disclosure comprises: a frame; a hanger body configured to move with respect to the frame in a predetermined vibration direction (+X, −X) and provided to hang clothes or clothes hangers; and a vibration module generating vibrations, wherein the vibration module comprises: a vibrating body configured to move with respect to the frame; a first eccentric portion that is supported by the vibrating body and rotates around a predetermined first rotational axis in such a way that the weight is off-center; a second eccentric portion that is supported by the vibrating body and rotates around a predetermined second rotational axis, which is the same as or parallel to the first rotational axis, in such a way that the weight is off-center; and a hanger driving unit that connects the vibrating body and the hanger body and transmits the vibration of the vibrating body to the hanger body, wherein, when the first eccentric portion generates a centrifugal force toward one side D1 in the vibration direction (+X, −X) with respect to the first rotational axis, the second eccentric portion generates a centrifugal force toward the one side D1 with respect to the second rotational axis, and, when the first eccentric portion generates a centrifugal force toward one side D2 in a direction (+Y, −Y) intersecting the vibration direction (+X, −X) with respect to the first rotational axis, the second eccentric portion generates a centrifugal force toward the opposite side of the one side D2 with respect to the second rotational axis.

In order to address the aforementioned aspects, a clothes treatment apparatus according to an exemplary embodiment of the present disclosure comprises: a frame; a hanger body configured to move with respect to the frame in a predetermined vibration direction (+X, −X) and provided to hang clothes or clothes hangers; and a vibration module generating vibrations, wherein the vibration module comprises: a vibrating body configured to move with respect to the frame; a first eccentric portion that is supported by the vibrating body and rotates around a predetermined first rotational axis in such a way that the weight is off-center; a second eccentric portion that is supported by the vibrating body and rotates around a predetermined second rotational axis, which is the same as or parallel to the first rotational axis, in such a way that the weight is off-center; and a hanger driving unit that connects the vibrating body and the hanger body and transmits the vibration of the vibrating body to the hanger body, wherein, when the weight of the first eccentric portion is off-centered to one side D1 in the vibration direction (+X, −X) with respect to the first rotational axis, the weight of the second eccentric portion is off-centered to the one side D1 with respect to the second rotational axis, and, when the weight of the first eccentric portion is off-centered to one side D2 in a direction (+Y, −Y) intersecting the vibration direction (+X, −X) with respect to the first rotational axis, the weight of the second eccentric portion is off-centered to the opposite side of the one side D2 with respect to the second rotational axis.

In order to address the aforementioned aspects, a vibration module for a clothes treatment apparatus according to an exemplary embodiment of the present disclosure comprises: a vibrating body; a first eccentric portion that is supported by the vibrating body and rotates around a predetermined rotational axis in such a way that the weight is off-center; a second eccentric portion that is supported by the vibrating body and rotates around the rotational axis in such a way that the weight is off-center; and a hanger driving unit configured to connect the vibrating body and an external hanger body.

The hanger body may be configured to move with respect to the frame in a predetermined vibration direction (+X, −X), and the centrifugal force of the first eccentric portion with respect to the first rotational axis and the centrifugal force of the second eccentric portion with respect to the second rotational axis may be set to reinforce each other in the vibration direction (+X, −X) and offset each other in a direction (+Y, −Y) intersecting the vibration direction (+X, −X).

The centrifugal force of the first eccentric portion and the centrifugal force of the second eccentric portion may be set to completely offset each other in the direction (+Y, −Y) intersecting the vibration direction (+X, −X).

The first rotational axis and the second rotational axis may be the same.

The vibrating body may be configured to be fixed to the hanger body and move integrally with the hanger body.

The clothes treatment apparatus may further comprise a motor disposed on the vibrating body, the first rotational axis and the second rotational axis may be the same, and, when viewed from the direction in which the first rotational axis extends, the hanger driving unit is fixed to the hanger body, in a position between the center of mass of the motor and the first rotational axis.

The clothes treatment apparatus may comprise: a frame forming the external appearance and having a treatment space for storing clothes; a hanger module in an upper portion of the treatment space, configured to move with respect to the frame and provided to hang clothes or clothes hangers; a supporting member fixed to the frame and having a center axial portion protruding along a vertically-extending, center axis; and a vibration module rotatably fixed to the center axial portion of the supporting member and generating vibrations on the hanger module, wherein the vibration module comprises: a motor rotating with respect to a motor shaft perpendicular to the center axis; a first eccentric portion rotating in connection with the motor, which rotates around a first rotational axis, spaced apart from and in parallel with the center axis, in such a way that the weight is off-center; a second eccentric portion rotating in connection with the motor, which rotates around the first rotational axis in such a way that the weight is off-center toward the opposite direction of the first eccentric portion; a vibrating body that supports the motor, rotatably supports the first eccentric portion and the second eccentric portion, and moves clockwise or counterclockwise with respect to the center axis, by the centrifugal force of the first eccentric portion with respect to the first rotational axis and the centrifugal force of the second eccentric portion with respect to the second rotational axis; and a hanger driving unit that transmits a force generated by the movement of the vibrating body to the hanger module.

Advantageous Effects

Through the above means to solve the problems, the centrifugal force F1 of the first eccentric portion and the centrifugal force F2 of the second eccentric portion may reinforce each other and apply an excitation force Fo to the hanger body, if they cause a rotation of the vibrating body around the center axis, whereas the centrifugal force F1 and the centrifugal force F2 may offset each other and suppress vibrations generated by centrifugal force not related to the generation of excitation force Fo, if they cause no rotation of the vibrating body around the center axis (see FIGS. 2*a* to 3*d*).

It is possible to further minimize unnecessary vibrations generated in a direction (+Y, −Y) perpendicular to a predetermined vibration direction (+X, −X), because the centrifugal force F1 and the centrifugal force F2 are set to "completely offset" each other.

The first eccentric portion and the second eccentric portion are configured to rotate at the same angular speed, thereby allowing for periodic reinforcement and offsetting of the centrifugal forces F1 and F2 caused by the rotation of the first eccentric portion and second eccentric portion.

The angular speed of the first eccentric portion and the angular speed of the second eccentric portion are set equal but in opposite directions, thereby making it easy for the centrifugal force F1 of the first eccentric portion and the centrifugal force F2 of the second eccentric portion to reinforce or offset each other repeatedly.

The first eccentric portion and the second eccentric portion are configured to rotate around the same axis of rotation. Accordingly, the point of action at which the centrifugal force F1 of the first eccentric portion and the centrifugal force F2 of the second eccentric portion are applied can be positioned on a single rotational axis Ow1 and Ow2, the centrifugal force F1 and the centrifugal force F2 can efficiently reinforce and offset each other, and it is possible to prevent a local moment load created by the horizontal distance difference between the point of action of the centrifugal force F1 and the point of action of the centrifugal force F2.

Since the hanger driving unit is fixed to the hanger body, in a position between the center of mass of the motor and the first rotational axis, this can reduce torsion caused by the center of mass of the motor when an excitation force is transmitted to the hanger body from the vibration module, thereby creating more stable vibrating motion.

BRIEF DESCRIPTION OF THE DRAWINGS

FIGS. 2*a* to 3*d* are conceptual diagrams showing the operating principle of the vibration module 50 of FIG. 1:

FIGS. 2*a* to 2*d* are views showing the operating principle of the vibration module 350 according to a first exemplary embodiment; and FIGS. 3*a* to 3*d* are views showing the operating principle of the vibration module 450 according to a second exemplary embodiment.

DETAILED DESCRIPTION OF THE EMBODIMENTS

Figure 1:
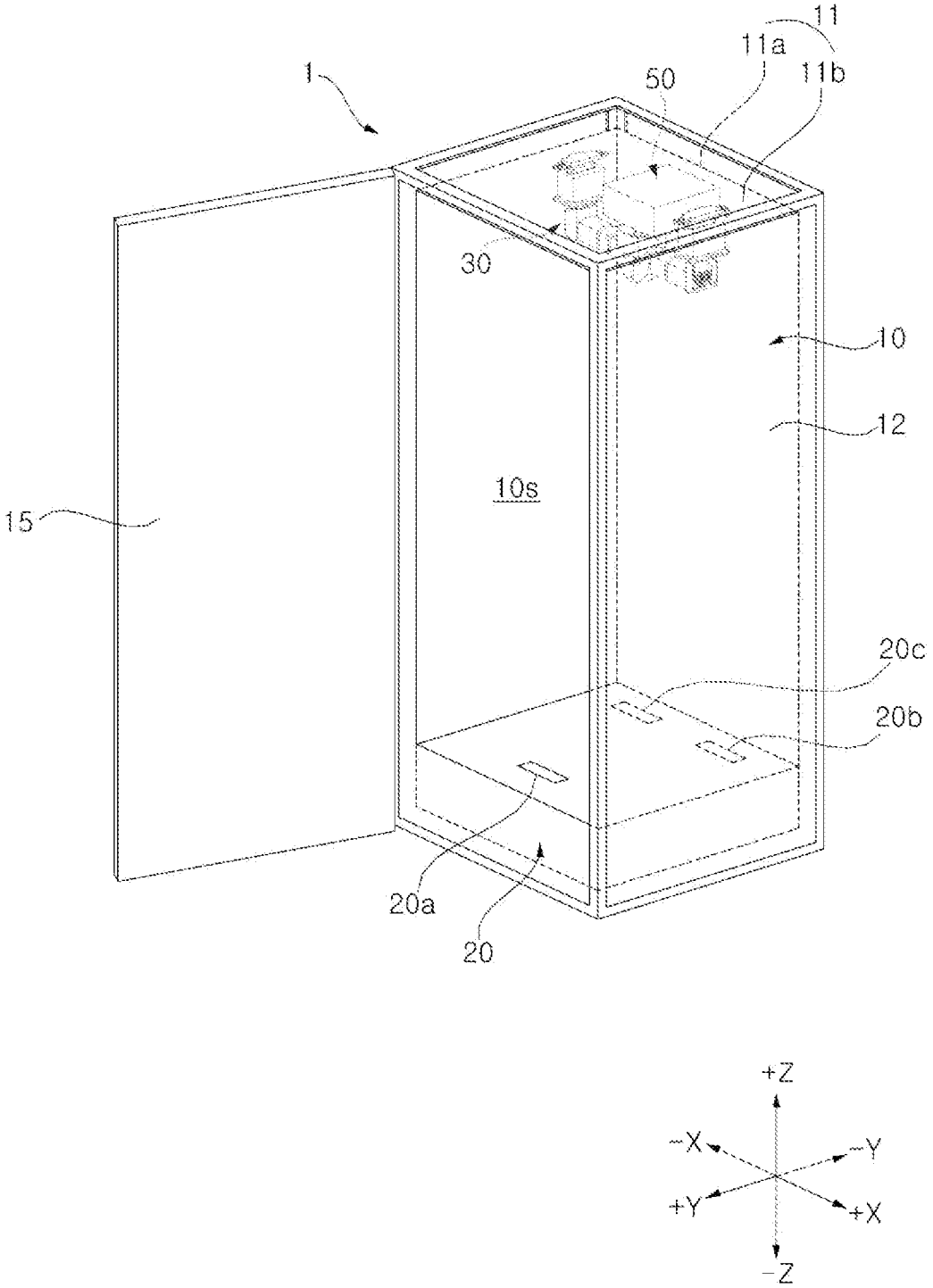
FIG. 1 is a perspective view of a clothes treatment apparatus 1 according to an exemplary embodiment of the present disclosure.

To explain the present disclosure, a description will be made below with respect to a spatial orthogonal coordinate system where X, Y, and Z axes are orthogonal to each other. Each axis direction (X-axis direction, Y-axis direction, and Z-axis direction) refers to two directions in which each axis runs. Each axis direction with a '+' sign in front of it (+X-axis direction, +Y-axis direction, and +Z-axis direction) refers to a positive direction which is one of the two directions in which each axis runs. Each axis direction with a '−' sign in front of it (−X-axis direction, −Y-axis direction, and −Z-axis direction) refers to a negative direction which is the other of the two directions in which each axis runs.

The terms mentioned below to indicate directions such as "front(+Y)/back(−Y)/left(+X)/right(−X)/up(+Z)/down(−Z)" are defined by the X, Y, and Z coordinate axes, but they are merely used for a clear understanding of the present disclosure, and it is obvious that the directions may be defined differently depending on where the reference is placed.

The terms with ordinal numbers such as "first", "second", "third", etc. added to the front are used to describe constituent elements mentioned below, are intended only to avoid confusion of the constituent elements, and are unrelated to the order, importance, or relationship between the constituent elements. For example, an embodiment including only a second component but lacking a first component is also feasible.

Th singular forms used herein are intended to include plural forms as well, unless the context clearly indicates otherwise.

Referring to FIG. 1, and FIGS. 6 to 12, a clothes treatment apparatus 1 according to an exemplary embodiment of the present disclosure comprises a frame 10 placed on a floor on the outside or fixed to a wall on the outside. The frame 10 has a treatment space 10*s* for storing clothes. The clothes treatment apparatus 1 comprises a supply part 20 for supplying at least one among air, steam, a deodorizer, and an anti-static agent to clothes. The clothes treatment apparatus 1 comprise a hanger module 30, 330, and 430 provided to hang clothes or clothes hangers. The hanger module 30, 330, and 430 is supported by the frame 10. The clothes treatment apparatus 1 comprises a vibration module 50, 350, and 450 for generating vibration. The vibration module 50, 350, and 450 vibrates the hanger module 30, 330, and 430. The clothes treatment apparatus 1 comprises at least one elastic member 360 and 460 configured to elastically deform or regain its elasticity when the hanger module 30, 330, and 430 moves. The elastic member 360 and 460 is configured to elastically deform or regain its elasticity when the vibration module 50, 350, and 450 moves. The clothes treatment apparatus 1 comprises a supporting member 370 and 470 for supporting one end of the elastic member 360 and 460. The supporting member 370 and 470 may movably support the vibration module 50, 350, and 450. The supporting member 370 and 470 may be fixed to the frame 10. The clothes treatment apparatus 1 may comprise a control part (not shown) for controlling the operation of the supply part 20. The control part may control whether to operate the vibration module 50, 350, and 450 or not and its operating pattern. The clothes treatment apparatus 1 may further comprise a clothes recognition sensor (not shown) for sensing clothes contained inside the treatment space 10*s*.

The frame 10 forms the external appearance. The frame 10 forms the treatment space 10*s* in which clothes are stored. The frame 10 comprises a top frame 11 forming the top side, a side frame 12 forming the left and right sides, and a rear frame (not shown) forming the rear side. The frame 10 comprises a base frame (not shown) forming the bottom side.

The frame 10 may comprise an interior frame 11*a* forming the inner side and an exterior frame 11*b* forming the outer side. The inner side of the interior frame 11*a* forms the treatment space 10*s*. A configuration space 11*s* is formed between the interior frame 11*a* and the exterior frame 11*b*. The vibration module 50, 350, and 450 may be disposed within the configuration space 11*s*. The elastic member 360 and 460 and the supporting member 370 and 470 may be disposed within the configuration space 11*s*.

The treatment space 10*s* is a space in which air (for example, hot air), steam, a deodorizer, and/or an anti-static agent is applied to clothes so as to change physical or chemical properties of the clothes. Clothes treatment may be done on the clothes in the treatment space 10*s* by various methods—for example, applying hot air to the clothes in the treatment space 10 to dry the clothes, removing wrinkles on the clothes with steam, spraying a deodorizer to clothes to give them a fragrance, spraying an anti-static agent to clothes to prevent static cling on them.

At least part of the hanger module 30, 330, and 430 is disposed within the treatment space 10*s*. A hanger body 331 and 431 is disposed within the treatment space 10*s*. One side of the treatment space 10*s* is open so that clothes can be taken in and out, and the open side is opened or closed by a door 15. When the door 15 is closed, the treatment space 10*s* is separated from the outside, and when the door 15 is opened, the treatment space 10*s* is exposed to the outside.

The supply part 20 may supply air into the treatment space 10*s*. The supply part 20 may circulate the air in the treatment space 10*s* while supplying it. Specifically, the supply part 20 may draw in air from inside the treatment space 10*s* and discharge it into the treatment space 10*s*. The supply part 20*s* may supply outside air into the treatment space 10*s*.

The supply part 20 may supply air that has undergone a predetermined treatment process into the treatment space 10*s*. For example, the supply part 20 may supply heated air into the treatment space 10*s*. The supply part 20 also may supply cooled air into the treatment space 10*s*. Moreover, the supply part 20 may supply untreated air into the treatment space 10*s*. Further, the supply part 20 may add steam, a deodorizer, or an anti-static agent to air and supply the air into the treatment space 10*s*.

The supply part 20 may comprise an air intake opening 20*a* through which air is drawn in from inside the treatment space 10*s*. The supply part 20 may comprise an air discharge opening 20*b* through which air is discharged into the treatment space 10*s*. The air drawn in through the air intake opening 20*a* may be discharged through the air discharge opening 20*b* after a predetermined treatment. The supply part 20 may comprise a steam spout 20*c* for spraying steam into the treatment space 10*s*. The supply part 20 may comprise a heater (not shown) for heating drawn-in air. The supply part 20 may comprise a filter (not shown) for filtering drawn-in air. The supply part 20 may comprise a fan (not shown) for pressurizing air.

The air and/or steam supplied by the supply part 20 is applied to the clothes stored in the treatment space 10*s* and affects the physical or chemical properties of the clothes. For example, the tissue structure of the clothes is relaxed by hot air or steam, so that the wrinkles are smoothed out, and an unpleasant odor is removed as odor molecules trapped in the clothes react with steam. In addition, the hot air and/or steam generated by the supply part 20 may sterilize bacteria present in the clothes.

Referring to FIG. 1, FIG. 8, FIG. 9, and FIG. 12, the hanger module 30, 330, and 430 may be disposed above the treatment space 10*s*. The hanger module 30, 330, and 430 is provided to hang clothes or clothes hangers. The hanger module 30, 330, and 430 is supported by the frame 10. The hanger module 30, 330, and 430 is movable. The hanger module 30, 330, and 430 is connected to the vibration module 50, 350, and 450 and receives vibrations from the vibration module 50, 350, and 450.

The hanger module 30, 330, and 430 comprises a hanger body 331 and 431 provided to hang clothes or clothes hangers. In this exemplary embodiment, the hanger body 331 and 431 may be formed with locking grooves 31*a* for hanging clothes hangers, and, in another exemplary embodiment, the hanger body 331 and 431 may be formed with hooks (not shown) or the like so that clothes are hung directly on them.

The hanger body 331 and 431 is supported by the frame 10. The hanger body 331, and 431 may be connected to the frame 10 through a hanger moving portion 33 and a hanger supporting portion 35. The hanger body 331 and 431 is configured to move with respect to the frame 10. The hanger body 331 and 431 is configured to move (vibrate) with respect to the frame 10 in a predetermined vibration direction (+X, −X). The hanger body 331 and 431 may vibrate with respect to the frame 10 in the vibration direction (+X, −X). The hanger body 331 and 431 reciprocates in the vibration direction (+X, −X) by the vibration module 50, 350, and 450. The hanger module 30, 330, and 430 reciprocates while hanging in an upper portion of the treatment space 10*s*.

The hanger body 331 and 431 may extend longitudinally in the vibration direction (+X, −X). A plurality of locking grooves 31*a* may be disposed on the upper side of the hanger body 331 and 431, spaced apart from each other, in the vibration direction (+X, −X). The locking grooves 31*a* may extend in a direction (+Y, −Y) intersecting the vibration direction (+X, −X).

The hanger module 30, 330, and 430 may comprise a hanger moving portion 33 which movably supports the hanger body 331 and 431. The hanger moving portion 33 is movable in the vibration direction (+X, −X). The hanger moving portion 33 may be made of a flexible material so as to make the hanger body 331 and 431 move. The hanger moving portion 33 may comprise an elastic member that is elastically deformable when the hanger body 331 and 431 moves. The upper end of the hanger moving portion 33 is fixed to the frame 10, and the lower end is fixed to the hanger body 331 and 431. The hanger moving portion 33 may extend vertically. The upper end of the hanger moving portion 33 rests on a hanger supporting portion 35. The hanger moving portion 33 connects the hanger supporting portion 35 and the hanger body 331 and 431. The hanger moving portion 33 is configured to vertically penetrate a hanger guide portion 37. The length of a horizontal cross-section of the hanger moving portion 33 in the vibration direction (+X, −X) is shorter than its length in the direction (+Y, −Y) perpendicular to the vibration direction (+X, −X).

The hanger module 30, 330, and 430 comprises a hanger supporting portion 35 fixed to the frame 10. The hanger supporting portion 35 secures the hanger moving portion 33 to the frame 10. The hanger supporting portion 35 may be fixed to the interior frame 11*a*. The upper end of the hanger moving portion 33 may be locked and hung on the hanger supporting portion 35. The hanger supporting portion 35 may be formed in the shape of a horizontal plate, and the hanger moving portion 33 may be configured to penetrate the hanger supporting portion 35.

The hanger module 30, 330, and 430 may further comprise a hanger guide portion 37 for guiding the position of the hanger moving portion 33. The hanger guide portion 37 is fixed to the frame 10. The gap between the upper side of the hanger guide portion 37 and the hanger moving portion 33 may be sealed. The lower portion of the hanger guide portion 37 has an upward recess formed in it, and the hanger moving portion 33 may move in the vibration direction (+X, −X) within the upward recess of the hanger guide portion 37.

The vibration module 50, 350, and 450 comprises a hanger driving unit 358 and 458 connected to the hanger module 30, 330, and 430. The hanger body 331 and 431 comprises a hanger driven unit 331*b* and 431*b* connected to the hanger driving unit 358 and 458.

Figure 8:
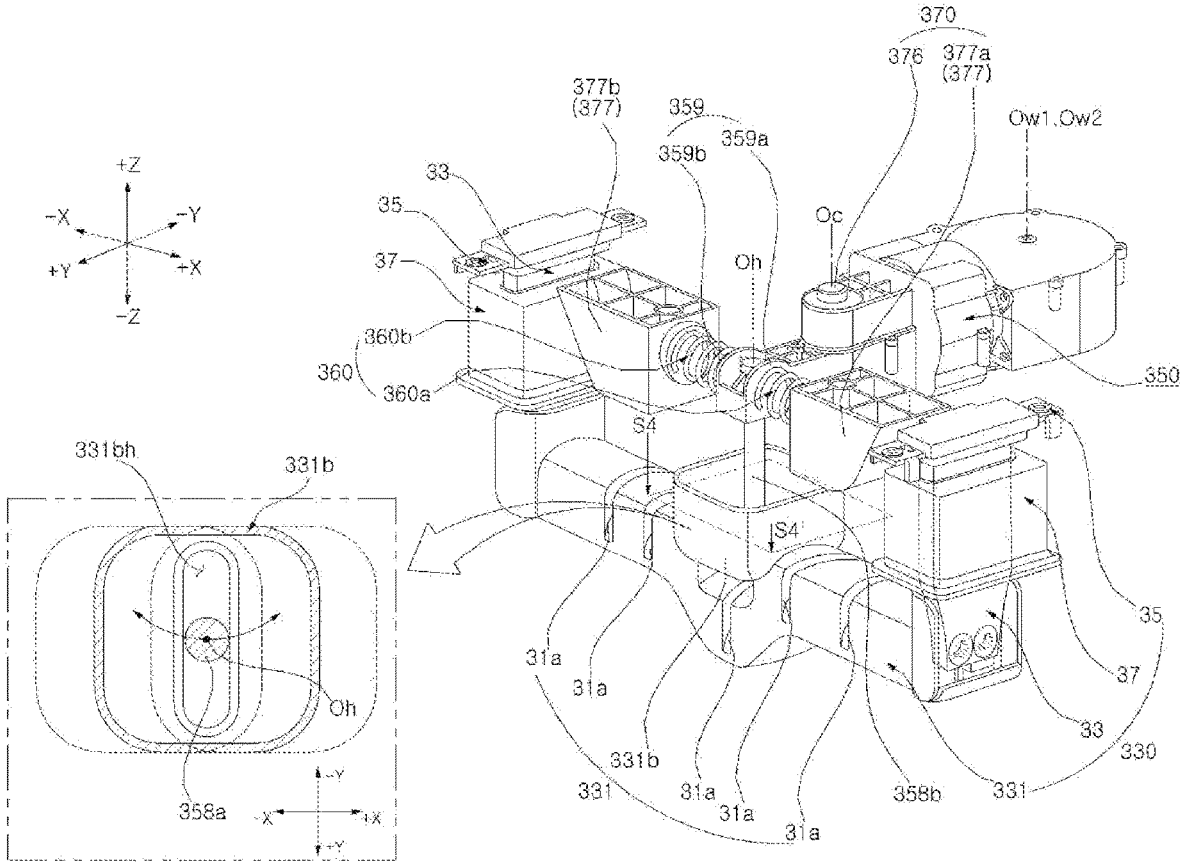
FIG. 8 is a perspective view showing the vibration module 350, elastic member 360, supporting member 370, and hanger module 330 according to the structural example of FIG. 6 and a partial cross-sectional view of the hanger driving unit 358 and hanger driven unit 331*b*, horizontally taken along the line S4-S4'.
Figure 9:
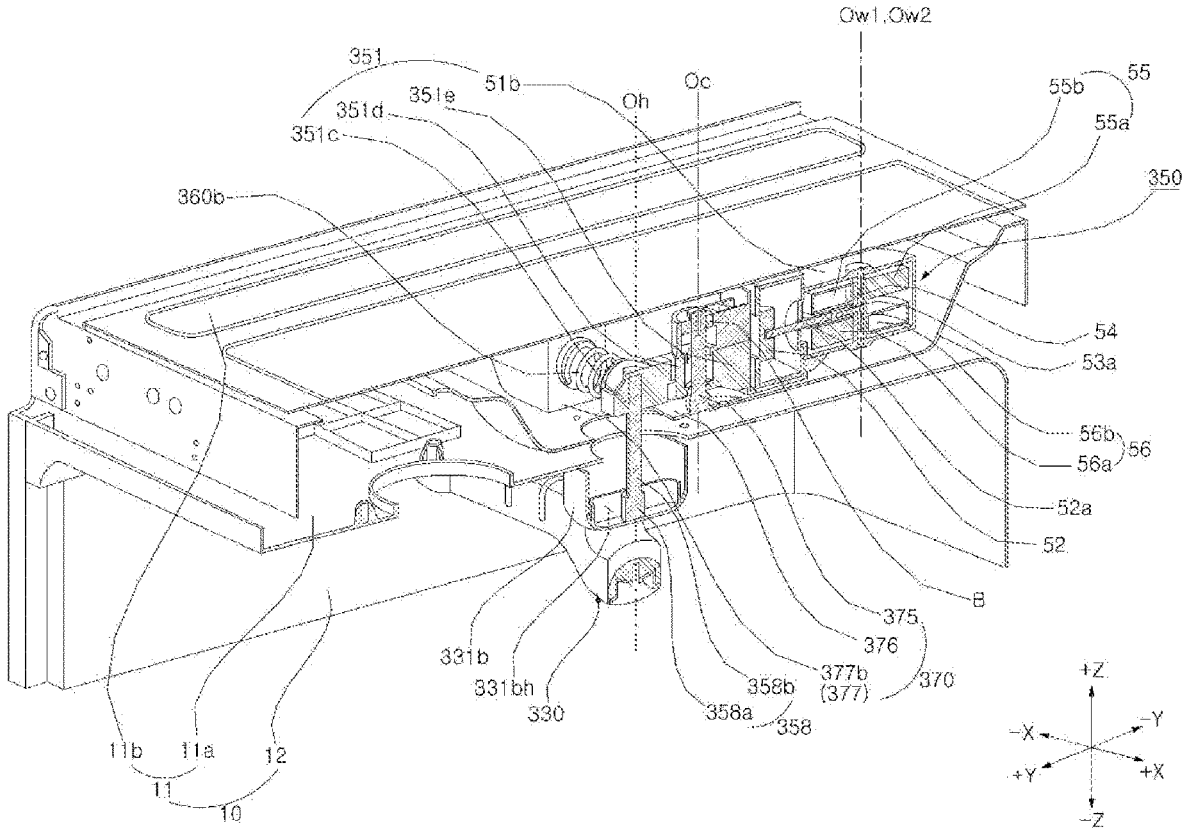
FIG. 9 is a vertical cross-sectional view of the structural example of FIG. 7, taken along the line S3-S3'.

Referring to FIGS. 8 and 9, the hanger driving unit 358 and hanger driven unit 331*b* according to a first exemplary embodiment of the present disclosure will be described below. Either the hanger driving unit 358 or the hanger driven unit 331*b* has a slit that extends in the direction (+Y, −Y) intersecting the vibration direction (+X, −X), and the other has a protruding portion that protrudes in parallel with a center axis Oc to be described later and is inserted into the slit. In this exemplary embodiment, the hanger driven unit 331*b* has a slit 331*bh* that extends in the direction (+Y, −Y), and the hanger driving unit 358 comprises a protruding portion 358*a* that protrudes downward and is inserted into the slit 331*bh*. Although not shown, another exemplary embodiment may be given in which the hanger driven unit has a slit that extends in the direction (+Y, −Y) and the hanger driving unit comprises a protruding portion that protrudes upward and is inserted into the slit of the hanger driving unit.

In the first exemplary embodiment, the protruding portion 358*a* protrudes in parallel with the center axis Oc. The protruding portion 358*a* extends along a predetermined connection axis Oh to be described later. The protruding portion 358*a* is disposed on the connection axis Oh. The slit 331*bh* is formed longitudinally in the direction (+Y, −Y) perpendicular to the vibration direction (+X, −X) of the hanger module 330. When the protruding portion 358*a* rotates with respect to the center axis Oc while inserted in the slit 331*bh*, the protruding portion 358*a* moves relative to the slit 331*bh* in the perpendicular direction (+Y, −Y), causing the hanger body 331 to reciprocate in the vibration direction (+X, −X). In the partial cross-sectional views of FIG. 8, the direction in which the protruding portion 358*a* inserted in the slit 331*bh* moves in an arc (rotates) within a predetermined range is indicated by an arrow, and therefore the range of movement of the hanger driven unit 331*b* vibrating in the left-right direction (+X, −X) is indicated by a dotted line.

Figure 12:
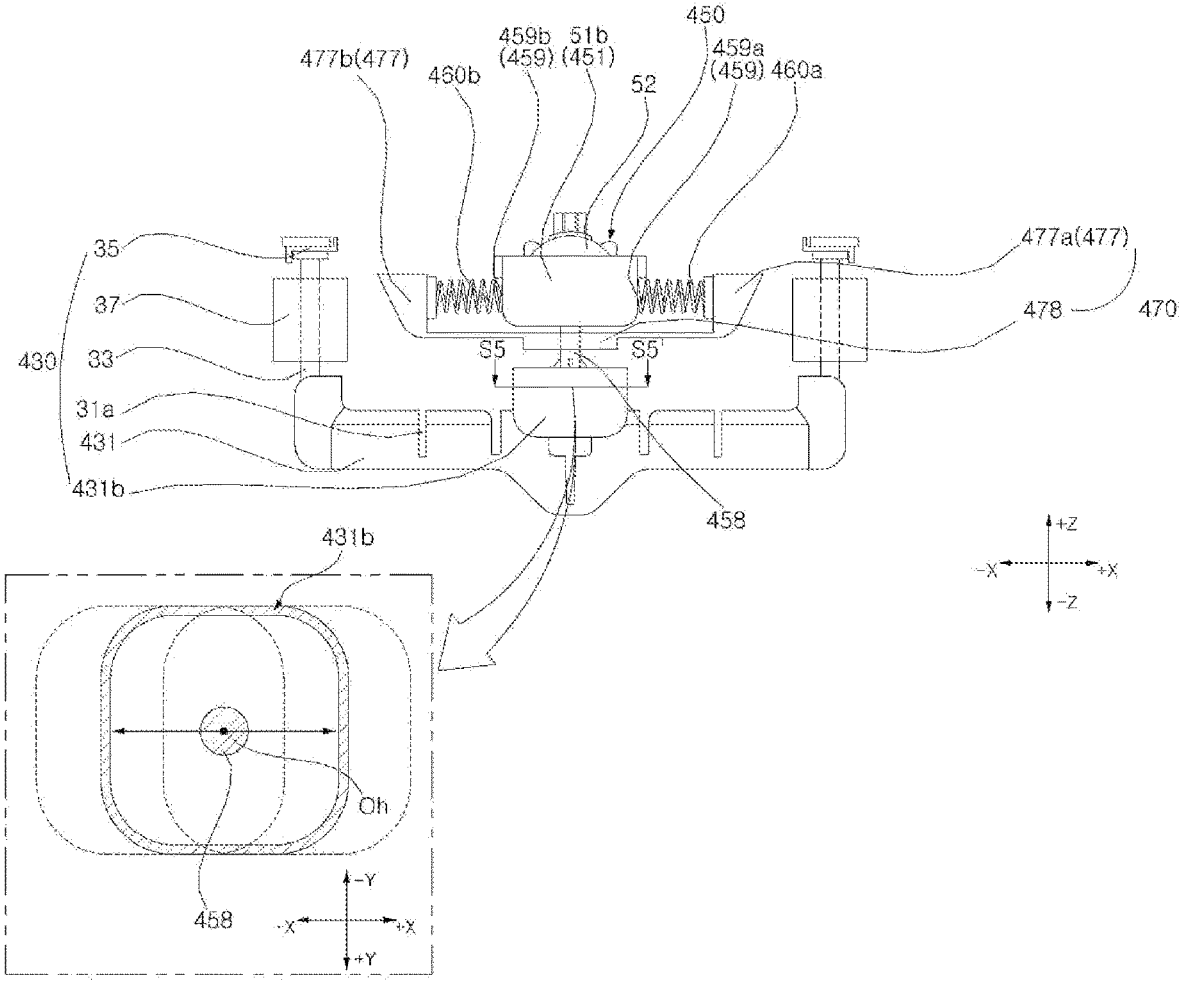
FIG. 12 is an elevation view of the vibration module 450, elastic member 460, supporting member 470, and hanger module 430 according to the structural example of FIG. 11 and a partial cross-sectional view of the hanger driving unit 458 and hanger driven unit 431*b*, horizontally taken along the line S5-S5'.

Referring to FIG. 12, the hanger driving unit 458 and hanger driven unit 431*b* according to a second exemplary embodiment will be described below. The hanger driving unit 458 connects and holds together the vibrating body 451 and the hanger body 431. The hanger driving unit 458 may connect and hold together a lower portion of the vibrating body 451 and the center of the hanger body 431. Therefore, the vibrating body 451 and the hanger body 431 vibrate as a single unit.

In the second exemplary embodiment, the hanger driving unit 458 may extend in parallel with a center axis Oc. The hanger driving unit 458 may be in the shape of a bar. The hanger driving unit 458 may extend along a predetermined connection axis Oh to be described later. The hanger driving unit 458 may be disposed on the connection axis Oh. The hanger driven unit 431*b* may be in the shape of a casing that is open at the top. The hanger driving unit 458 is fixed to the hanger driven unit 431*b*. The upper end of the hanger driving unit 458 is fixed to the vibrating body 451, and the lower end is fixed to the hanger driven unit 431*b*. When the hanger driving unit 458, while fixed to the hanger driven unit 431*b*, reciprocates in the vibration direction (+X, −X) of the vibrating body 451, the hanger body 431 reciprocates in the vibration direction (+X, −X), integrally with the vibrating body 451. In the partial cross-sectional view of FIG. 12, the direction in which the hanger driving unit 458 linearly reciprocates is indicated by an arrow, and therefore the range of movement of the hanger driven unit 431*b* vibrating in the left-right direction (+X, −X) is indicated by a dotted line.

Referring to FIGS. 6 to 12, the elastic member 360 and 460 is configured to elastically deform or regain its elasticity when the vibration module 50, 350, and 450 vibrates. The elastic member 360 and 460 is configured to elastically deform or regain its elasticity when a vibrating body 351 and 451 vibrates. The elastic member 360 and 460 may restrict the vibration of the vibration module 50, 350, and 450 to a predetermined range. The vibration pattern (amplitude and vibration frequency) of the vibration module 50, 350, and 450 may be determined by putting together the elastic force of the elastic member 360 and 460 and the centrifugal force of the first eccentric portion 55 and second eccentric portion 56.

One end of the elastic member 360 and 460 is fixed to the vibration module 50, 350, and 450, and the other end is fixed to a supporting member 370 and 470. The elastic member 360 and 460 may comprise a spring or a mainspring. The supporting member 370 and 470 may comprise a tension spring, a compression spring, or a torsion spring.

Referring to FIGS. 6 to 9, the elastic member 360 according to the first exemplary embodiment is configured to elastically deform or regain its elasticity when the vibration module 350 rotates around the center axis Oc. The elastic member 360 is configured to elastically deform or regain its elasticity when the vibrating body 351 rotates around the center axis Oc. The elastic member 360 may restrict the vibration of the vibration module 350 to a predetermined angular range.

Figure 10:
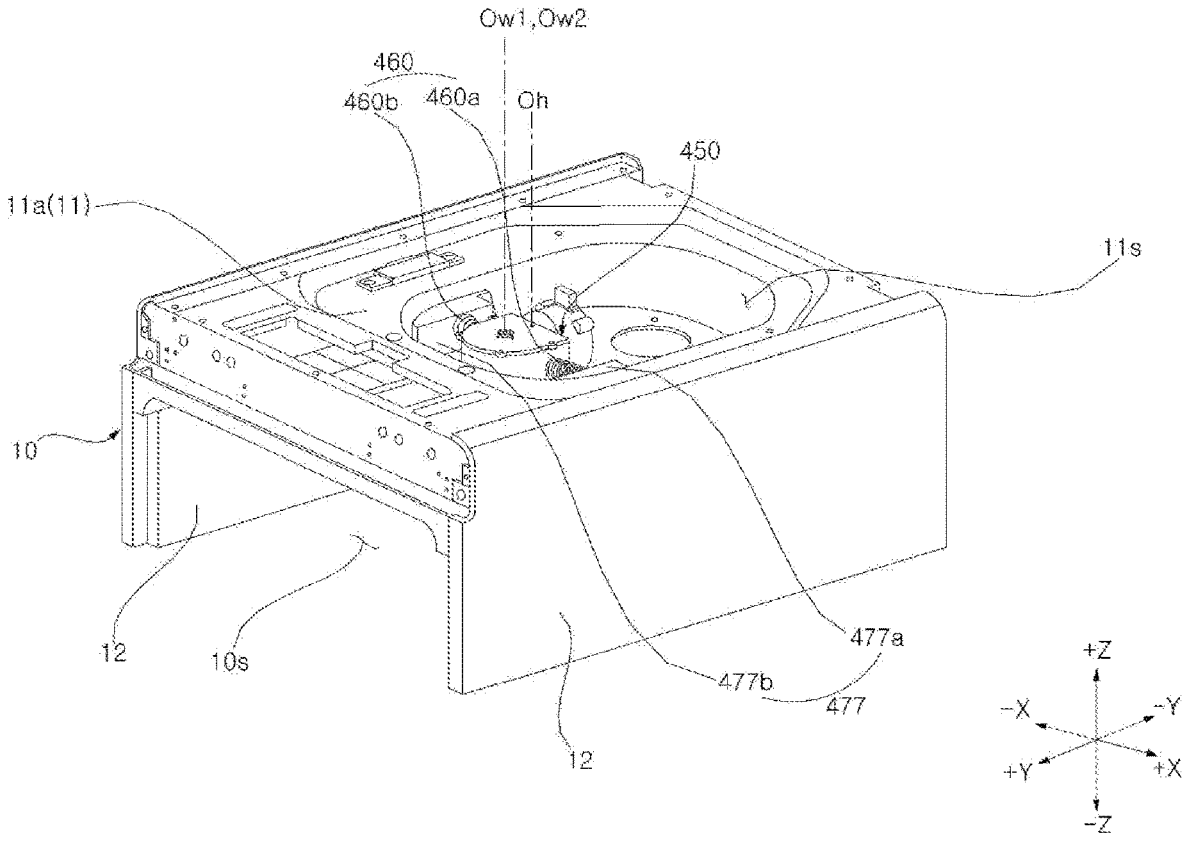
FIG. 10 is a partial perspective view showing a structural example of the vibration module 450, elastic member 460, and supporting member 470 according to a second exemplary embodiment in FIGS. 3*a* to 3*d*, from which the exterior frame 11*b* is omitted.
Figure 11:
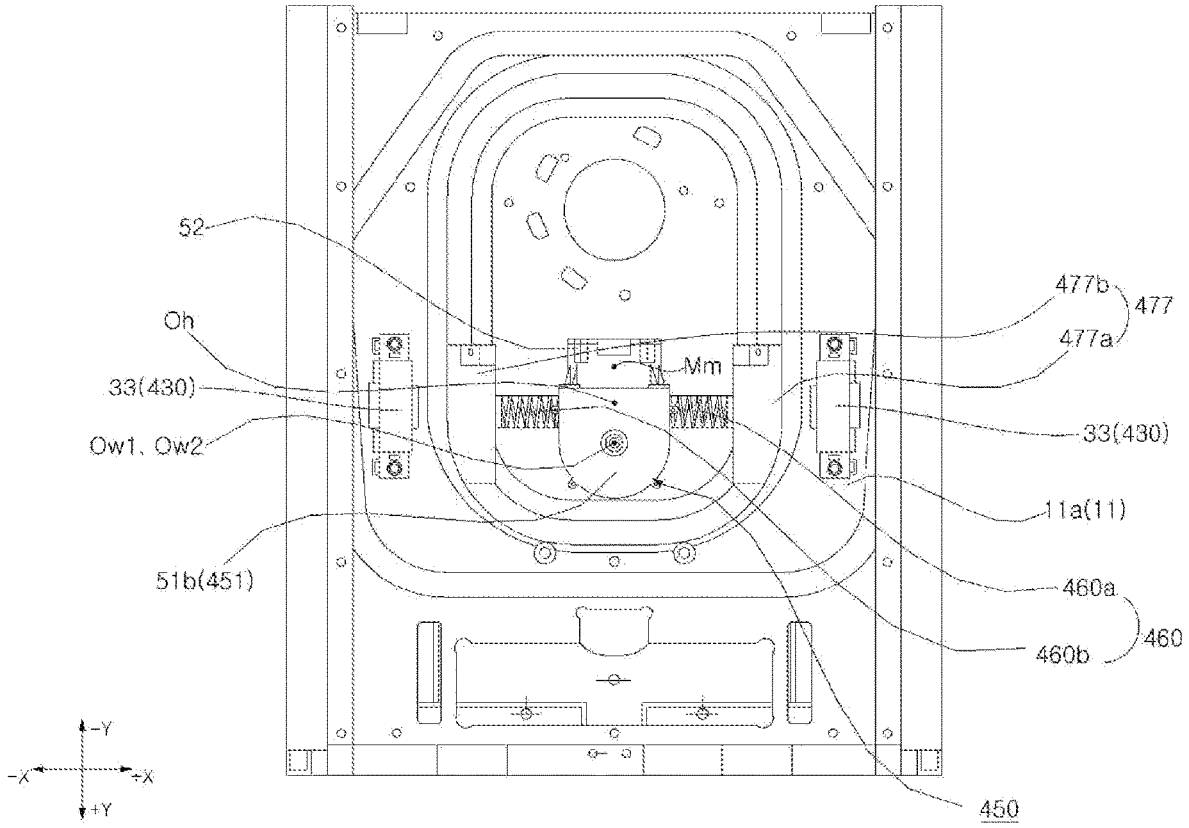
FIG. 11 is a top elevation view of the structural example of FIG. 10.

Referring to FIGS. 10 to 12, the elastic member 460 according to the second exemplary embodiment is configured to elastically deform or regain its elasticity when the vibration module 450 reciprocates in the vibration direction (+X, −X). The elastic member 460 is configured to elastically deform or regain its elasticity when the vibrating body 451 reciprocates in the vibration direction (+X, −X). The elastic member 460 may restrict the vibration of the vibration module 450 to a predetermined distance range.

Referring to FIGS. 6 to 12, the supporting member 370 and 470 is fixed to the frame 10. The supporting member 370 and 470 may be fixed to the interior frame 11*a*. The supporting member 370 and 470 may support the elastic member 360 and 460.

Referring to FIGS. 6 to 9, the supporting member 370 according to the first exemplary embodiment supports the vibration module 350. The vibration module 350 may be supported by the interior frame 11*a*. The vibration module 350 may be fixed to the frame 10 by the supporting member 370. The supporting member 370 movably supports the vibration module 350. The supporting member 370 rotatably supports the vibration module 350. The supporting member 370 supports the vibration module 350 in such a way as to make it movable around the center axis Oc. The supporting member 370 supports the vibrating body 351. The vibrating body 351 may be connected to the frame 10 by the supporting member 370.

Referring to FIGS. 10 to 12, the supporting member 470 according to the second exemplary embodiment does not need to support the vibration module 450. The vibration module 450 may be supported by the hanger module 430. The supporting member 470 may slidably support the vibration module 450. The supporting member 470 may guide the vibration direction (+X, −X) of the vibration module 450. The supporting member 470 may function as a guide that restricts the movement of the vibration module 450 in a direction other than a predetermined direction (+X, −X).

Referring to FIGS. 2*a* to 5, the vibration module 50, 350, and 450 will be briefly described below. The vibration module 50, 350, and 450 moves (vibrates) the hanger body 331 and 431. The vibration module 50, 350, and 450 is connected to the hanger body 331 and 431, and transmits vibrations from the vibration module 50, 350, and 450 to the hanger body 331 and 431.

The vibration module 50, 350, and 450 may be disposed between the interior frame 11*a* and the exterior frame 11*b*. The interior frame 11*a* on the upper side may be recessed downward to form the configuration space 11*s*, and the vibration module 50, 350, and 450 may be disposed in the configuration space 11*s*.

The vibration module 50, 350, and 450 may be located above the treatment space 10*s*. The vibration module 50, 350, and 450 may be disposed above the hanger body 331 and 431.

The vibration module 50, 350, and 450 comprises a vibrating body 351 and 451 configured to move with respect to the frame 10. The vibrating body 351 and 451 forms the outer appearance of the vibration module 50, 350, and 450.

A predetermined center axis Oc is preset on the vibrating body 351 according to the first exemplary embodiment. The vibrating body 351 is configured in such a way as to rotate around a predetermined center axis Oc where the position relative to the frame 10 is fixed. The supporting member 370 rotatably supports the vibrating body 351. The vibrating body 351 may be configured to rotate only within a predetermined angular range. For example, the frame 10 or the supporting member 370 may comprise a limit portion that can come into contact with the vibrating body 351, so as to restrict the range of rotation of the vibrating body 351. In another example, the elastic force of the elastic member 360 increases as the vibrating body 351 rotates, thus limiting the range of rotation of the vibrating body 351.

The center axis Oc is not preset on the vibrating body 451 according to the second exemplary embodiment. The position of the vibrating body 451 relative to the hanger body 431 is fixed. The hanger driving unit 458 connects and holds the vibrating body 451 and the hanger body 431 together. The vibrating body 451 may be configured to reciprocate only within a predetermined distance range. For example, the frame 10 or the supporting member 470 may comprise a limit portion that can come into contact with the vibrating body 451, so as to restrict the range of reciprocating motion of the vibrating body 451. In another example, the elastic force of the elastic member 460 increases as the vibrating body 451 moves, thus limiting the range of movement (vibration) of the vibrating body 451.

The vibrating body 351 and 451 supports the motor 52. The vibrating body 351 and 451 and the hanger driving unit 358 and 458 are fixed to each other. The vibrating body 351 and 451 supports a weight shaft 54. The vibrating body 351 and 451 supports a first eccentric portion 55 and a second eccentric portion 56. The vibrating body 351 and 451 may accommodate the first eccentric portion 55 and the second eccentric portion 56 in it.

The vibrating body 351 and 451 may comprise a weight casing 51*b* containing the first eccentric portion 55 and the second eccentric portion 56 in it. The weight casing 51*b* may comprise a first part 51*b*2 forming an upper portion and a second part 51*b*1 forming a lower portion. The second part 51*b*1 may form an inner space forming the bottom surface and peripheral surface, and the first part 51*b*2 may cover the top of the inner space. The first eccentric portion 55 and the second eccentric portion 56 may be disposed vertically in the inner space of the weight casing 51*b*. The weight casing 51*b* may be attached to the motor 52. A hole through which the motor shaft 52*a* is inserted may be formed in one side of the weight casing 51*b*.

The vibration module 50, 350, and 450 may comprise a motor 52 that generates torque for the first eccentric portion 55 and second eccentric portion 56. The motor 52 is disposed on the vibrating body 351 and 451. The motor 52 comprises a rotating motor shaft 52*a*. For example, the motor 52 comprises a rotor and a stator, and the motor shaft 52*a* may rotate integrally with the rotor. The motor shaft 52*a* transmits torque to a transmitting portion 53. The motor shaft 52*a* is inserted and protrudes between the first eccentric portion 55 and the second eccentric portion 56. The motor shaft 52*a* is connected to the transmitting portion 53.

The vibration module 50, 350, and 450 may comprise a transmitting portion 53 that transmits the torque of the motor 52 to the first eccentric portion 55 and second eccentric portion 56. The transmitting portion 53 is disposed on the vibrating body 351 and 451. The transmitting portion 53 may comprise a gear, belt, and/or pulley.

The transmitting portion 53 comprises a bevel gear 53*a* that rotates integrally with the motor shaft 52*a*. The bevel gear 53*a* has a plurality of gear teeth arranged along the perimeter of the motor shaft 52*a*. Assuming that there is an imaginary straight line along the axis of rotation of the motor shaft 52*a*, the bevel gear 53*a* has a plurality of gear teeth that slope towards the imaginary straight line in the direction the motor shaft 52*a* protrudes. The bevel gear 53*a* is placed between the first eccentric portion 55 and the second eccentric portion 56.

The transmitting portion 53 may comprise a transmission shaft 53*g* that rotatably supports the bevel gear 53*a*. The transmission shaft 53*g* may be supported by the weight shaft 54. One end of the transmission shaft 53*g* may be fixed to the weight shaft 54, and the other end may be inserted into the center of the bevel gear 53*a*. The transmission shaft 53*g* may be fixed to the center of the weight shaft 54. The transmission shaft 53*g* may be placed between the first eccentric portion 55 and the second eccentric portion 56.

The vibration module 50, 350, and 450 comprises a first eccentric portion 55 that rotates around a predetermined first rotational axis Ow1 in such a way that the weight is off-center. The first eccentric portion 55 is configured to rotate around the first rotational axis Ow1 in such a way that the weight is off-center. The vibration module 50, 350, and 450 comprises a second eccentric portion 56 that rotates around a predetermined second rotational axis Ow2 in such a way that the weight is off-center. The second eccentric portion 56 is configured to rotate around the second rotational axis Ow2 in such a way that the weight is off-center. The first rotational axis Ow1 and the second rotational axis Ow2 may be the same or different.

The second rotational axis Ow2 is set to be the same as or parallel to the first rotational axis Ow1. While the first rotational axis Ow1 and the second rotational axis Ow2 in this exemplary embodiment are the same, the first rotational axis Ow1 and the second rotational axis Ow2 in other exemplary embodiments may be placed apart in parallel with each other. This makes it easy for the centrifugal force F1 of the first eccentric portion 55 and the centrifugal force F2 of the second eccentric portion 56 to reinforce or offset each other repeatedly.

In this exemplary embodiment, the first rotational axis Ow1 and the second rotational axis Ow2 are the same. Through this, the point of action at which the centrifugal force F1 of the first eccentric portion 55 and the centrifugal force F2 of the second eccentric portion 56 are applied can be positioned on a single rotational axis Ow1, the centrifugal force F1 and the centrifugal force F2 can efficiently reinforce and offset each other, and it is possible to prevent a local moment load created by the horizontal distance difference between the point of action of the centrifugal force F1 and the point of action of the centrifugal force F2.

The first rotational axis Ow1 and the second rotational axis Ow2 may be disposed in the same direction relative to the motor 52.

The first eccentric portion 55 is supported by the vibrating body 351 and 451. The first eccentric portion 55 may be rotatably supported by the weight shaft 54 disposed on the vibrating body 351 and 451. The second eccentric portion 56 is supported by the vibrating body 351 and 451. The second eccentric portion 56 may be rotatably supported by the weight shaft 54 disposed on the vibrating body 351 and 451.

The first eccentric portion 55 comprises a first rotating portion 55*b* rotating around the first rotational axis Ow1 in contact with the transmitting portion 53. The first rotating portion 55*b* receives torque from the transmitting portion 53. The first rotating portion 55*b* may be formed entirely in the shape of a cylinder around the first rotational axis Ow1.

The first rotating portion 55*b* may comprise a center portion 55*b*1 that makes rotatable contact with the weight shaft 54. The weight shaft 54 is placed to penetrate the center portion 55*b*1. The center portion 55*b*1 extends along the rotational axis Ow1 and Ow2. The center portion 55*b*1 has a center hole along the rotational axis Ow1 and Ow2. The center portion 55*b*1 may be formed in the shape of a pipe.

The first rotating portion 55*b* may comprise a peripheral portion 55*b*2 mounted to the center portion 55*b*1. The center portion 55*b*1 is placed to penetrate the peripheral portion 55*b*2. The peripheral portion 55*b*2 may be formed entirely in the shape of a cylinder that extends along the rotational axis Ow1 and Ow2. A mounting groove 55*b*3 where the first weight member 55*a* rests may be formed in the peripheral portion 55*b*2. The mounting groove 55*b*3 may be formed in such a way that its top is open. A centrifugal side of the mounting groove 55*b*3 around the rotational axis Ow1 and Ow2 may be blocked. The peripheral portion 55*b*2 and the first weight member 55*a* rotate as a single unit.

The first eccentric portion 55 comprises a toothed portion 55*b*4 that receives torque by meshing with the bevel gear 53*a*. The toothed portion 55*b*4 is formed on the underside of the peripheral portion 55*b*2. The toothed portion 55*b*4 is placed on the perimeter around the rotational axis Ow1 and Ow2. The toothed portion 55*b*4 slopes upward from the rotational axis Ow1 and Ow2.

The first eccentric portion 55 comprises a first weight member 55*a* fixed to the first rotating portion 55*b*. The first weight member 55*a* rotates integrally with the first rotating portion 55*b*. The first weight member 55*a* is made of a material with a higher specific gravity than the first rotating portion 55*b*.

The first weight member 55*a* is placed on one side around the first rotational axis Ow1, and causes the weight of the first eccentric portion 55 to be off-centered. The first weight member 55*a* may be formed entirely in the shape of a column whose base is semi-circular. The first weight member 55*a* may be disposed within an angular range of 180 degrees with respect to the first rotational axis Ow1, at a certain point in time during rotation of the first eccentric portion 55. In this exemplary embodiment, the first weight member 55*a* is disposed within the range of 180 degrees with respect to the first rotational axis Ow1, at the certain point in time.

The second eccentric portion 56 comprises a second rotating portion 56*b* rotating around the second rotational axis Ow2 in contact with the transmitting portion 53. The second rotating portion 56*b* receives torque from the transmitting portion 53. The second rotating portion 56*b* may be formed entirely in the shape of a cylinder around the second rotational axis Ow2.

The second eccentric portion 56 comprises a center portion 56*b*1 that makes rotatable contact with the weight shaft 54. The weight shaft 54 is placed to penetrate the center portion 56*b*1. The center portion 56*b*1 extends along the rotational axis Ow1 and Ow2. The center portion 56*b*1 has a center hole along the rotational axis Ow1 and Ow2. The center portion 56*b*1 may be formed in the shape of a pipe.

The second rotating portion 56*b* may comprise a peripheral portion 56*b*2 mounted to the center portion 56*b*1. The center portion 56*b*1 is placed to penetrate the peripheral portion 56*b*2. The peripheral portion 56*b*2 may be formed entirely in the shape of a cylinder that extends along the rotational axis Ow1 and Ow2. A mounting groove 56*b*3 where the second weight member 56*a* rests may be formed in the peripheral portion 56*b*2. The mounting groove 56*b*3 may be formed in such a way that its bottom is open. A centrifugal side of the mounting groove 56*b* around the rotational axis Ow1 and Ow2 may be blocked. The peripheral portion 56*b*2 and the second weight member 56*a* rotate as a single unit.

The second eccentric portion 56 comprises a toothed portion 56*b*4 that receives torque by meshing with the bevel gear 53*a*. The toothed portion 56*b*4 is formed on the topside of the peripheral portion 56*b*2. The toothed portion 56*b*4 is placed on the perimeter around the rotational axis Ow1 and Ow2. The toothed portion 56*b*4 slopes downward from the rotational axis Ow1 and Ow2.

The second eccentric portion 56 comprises a second weight member 56*a* fixed to the second rotating portion 56*b*. The second weight member 56*a* rotates integrally with the second rotating portion 56*b*. The second weight member 56*a* is made of a material with a higher specific gravity than the second rotating portion 56*b*.

The second weight member 56*a* is placed on one side with respect to the second rotational axis Ow2, and causes the weight of the second eccentric portion 56 to be off-centered. The second weight member 56*a* may be formed entirely in the shape of a column whose base is semi-circular. The second weight member 56*a* may be disposed within an angular range of 180 degrees with respect to the second rotational axis Ow2, at a certain point in time during rotation of the second eccentric portion 56. In this exemplary embodiment, the second weight member 56*a* is disposed within the range of 180 degrees with respect to the second rotational axis Ow2, at the certain point in time.

The first eccentric portion 55 and the second eccentric portion 56 may be arranged along the center axis Oc, spaced apart from each other. The first eccentric portion 55 and the second eccentric portion 56 may be placed to face each other. The first eccentric portion 55 may be placed above the second eccentric portion 56.

The first rotating portion 55*b* and the second rotating portion 56*b* may be the same weight. The first weight member 55*a* and the second weight member 56*a* may be the same weight.

Figure 5:
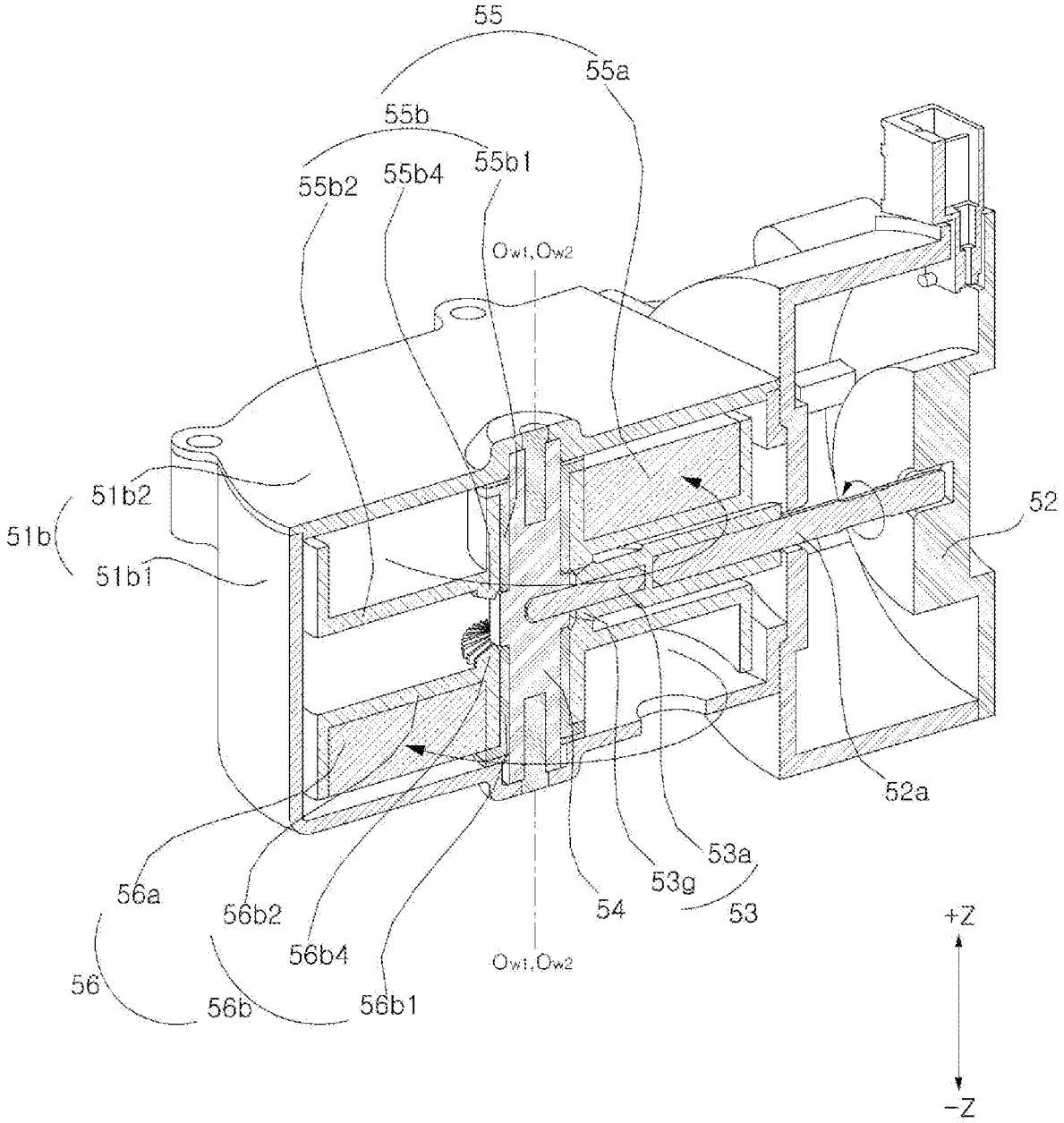
FIG. 5 is a vertical cross-sectional view of the elements of FIG. 4 in an assembled state.
Figure 6:
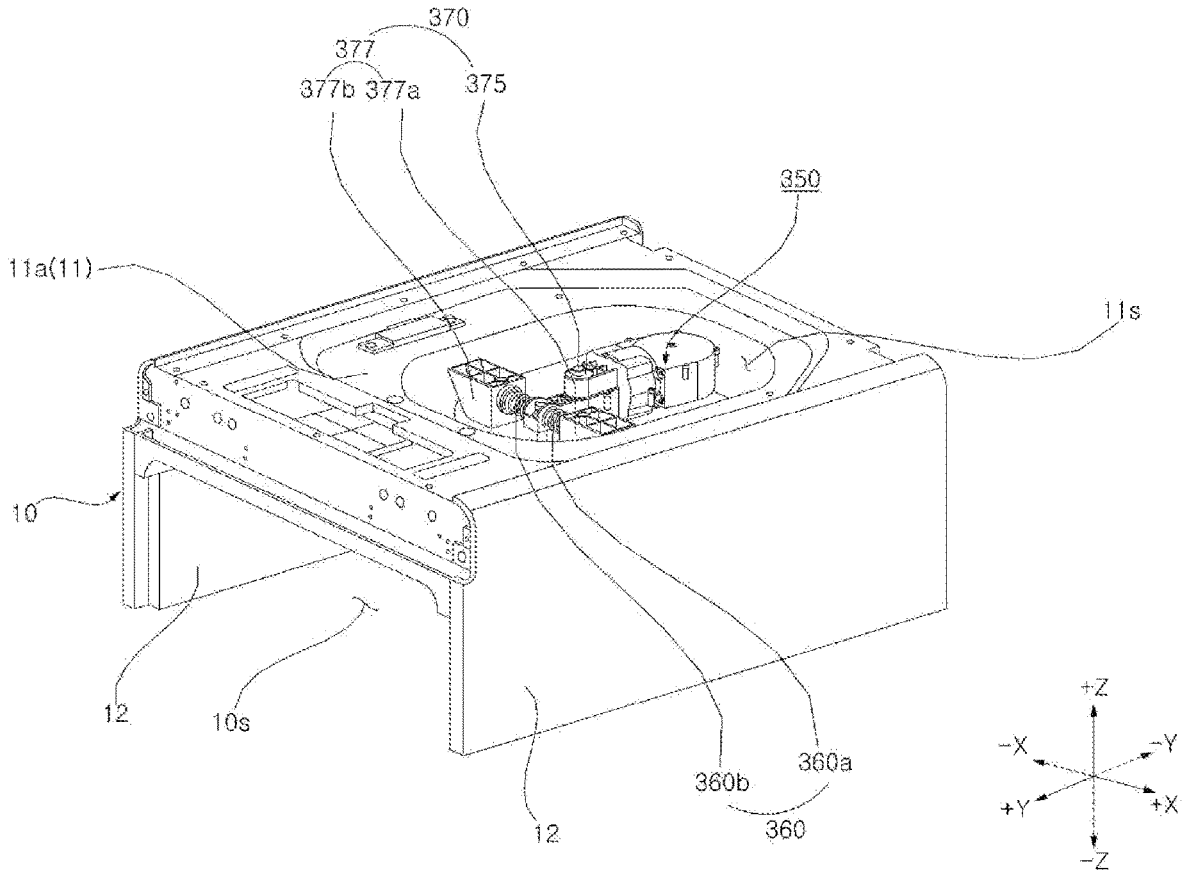
FIG. 6 is a partial perspective view showing a structural example of the vibration module 350, elastic member 360, and supporting member 370 according to a first exemplary embodiment in FIGS. 2*a* to 2*d*, from which the exterior frame 11*b* is omitted.
Figure 7:
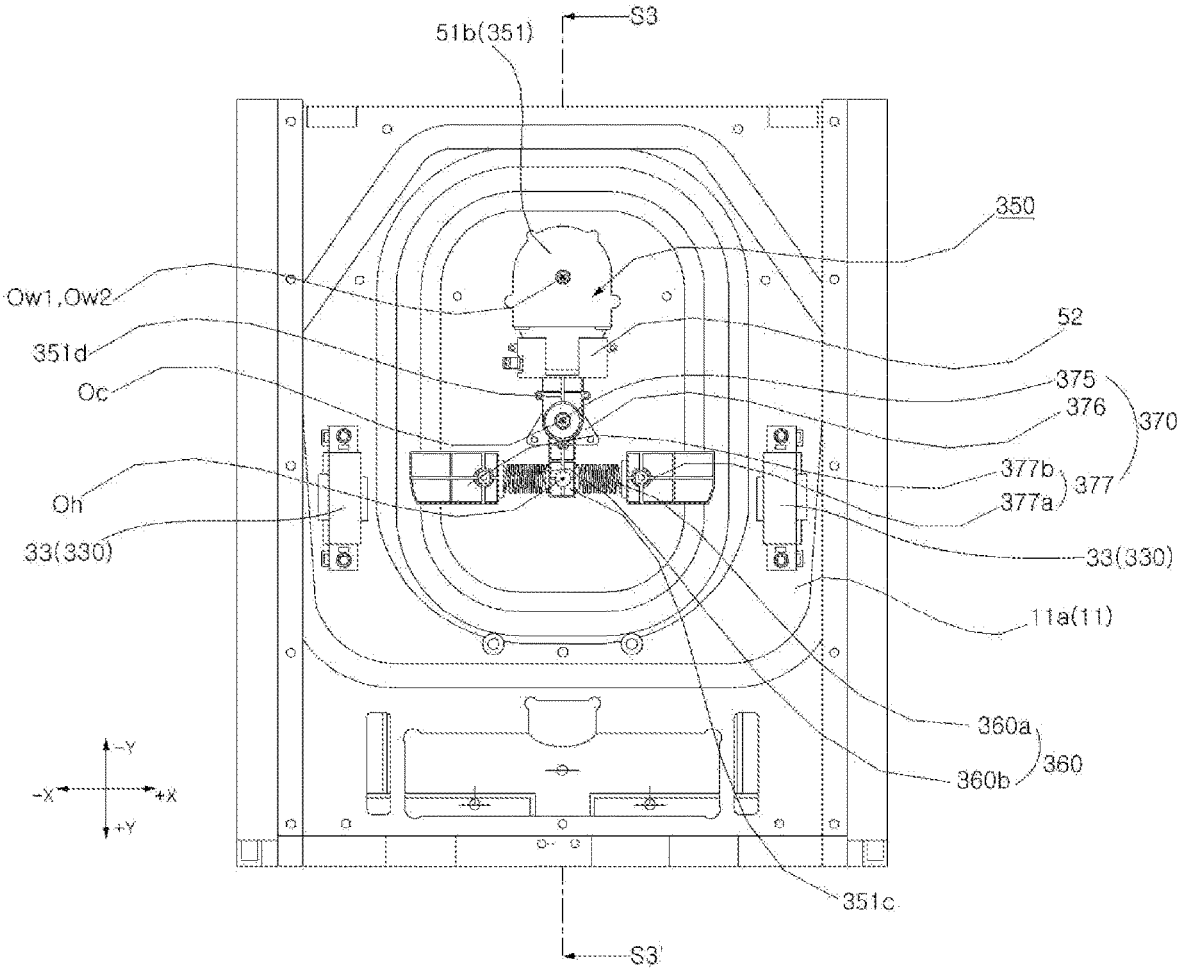
FIG. 7 is a top elevation view of the structural example of FIG. 6.

Referring to FIG. 5, when the motor shaft 52*a* and the bevel gear 53*a* rotate in one direction, the first eccentric portion 55 rotates counterclockwise and the second eccentric portion 56 rotates clockwise. The first eccentric portion 55 and the second eccentric portion 56 rotate in opposite directions.

The vibration module 50, 350, and 450 may comprise a weight shaft 54 that provides function to the first rotational axis Ow1 and second rotational axis Ow2. One weight shaft 54 may provide function to both the first rotational axis Ow1 and second rotational axis Ow2. The weight shaft 54 may be fixed to the vibrating body 351 and 451. The upper and lower ends of the weight shaft 54 may be fixed to the weight casing 51*b*. The weight shaft 54 is disposed on the first rotational axis Ow1 and the second rotational axis Ow2. The weight shaft 54 may be placed to penetrate the first eccentric portion 55 and the second eccentric portion 56.

The vibration module 50, 350, and 450 comprises a hanger driving unit 358 and 458 that connects the vibrating body 351 and 451 and the hanger body 331 and 431. The hanger driving unit 358 and 458 is configured to connect the vibrating body 351 and 451 and the hanger body 331 and 431 outside the vibration module 50, 350 and 450. The hanger driving unit 358 and 458 transmits the vibration of the vibrating body 351 and 451 to the hanger body 331 and 431. The hanger driving unit 358 and 458 may transmit the vibration of the vibrating body 351 and 451 to the hanger body 331 and 431, along the connection axis Oh.

The vibration module 50, 350, and 450 comprises an elastic member locking portion 359 and 459 on which one end of the elastic member 360 and 460 is locked. The elastic member locking portion 359 and 459 may be disposed on the vibrating body 351 and 451. The elastic member locking portion 359 and 459 may apply pressure to the elastic member 360 and 460 or receive elastic force from the elastic member 360 and 460, when the vibration module 50, 350, and 450 moves.

Hereinafter, the operating mechanism of the vibration module 50, 350, and 450 will be described below with reference to FIGS. 2*a* to 3*d*.

The vibration direction (+X, −X) refers to a preset direction in which the hanger body 331 and 431 reciprocates. In this exemplary embodiment, the left-right direction is preset as the vibration direction (+X, −X).

The "center axis Oc, first rotational axis Ow1, second rotational axis Ow2, and connection axis Oh mentioned throughout the present disclosure are imaginary axes used to describe the present disclosure, and do not designate actual components of the apparatus.

The first rotational axis Ow1 refers to an imaginary straight line through the center of rotation of the first eccentric portion 55. The first rotational axis Ow1 maintains a fixed position relative to the vibrating body 351 and 451. That is, even when the vibrating body 351 and 451 moves, the first rotational axis Ow1 moves integrally with the vibrating body 351 and 451 and maintains the position relative to the vibrating body 351 and 451. The first rotational axis Ow1 may extend vertically.

To provide the function of the first rotational axis Ow1, the weight shaft 54 disposed on the first rotational axis Ow1 may be provided as in this exemplary embodiment. To provide the function of the first rotational axis Ow1, in another exemplary embodiment, a projection protruding along the first rotational axis Ow1 may be formed on either the first eccentric portion 55 or the vibrating body 351 and 451, and a groove with which the projection rotatably engages may be formed in the other.

The second rotational axis Ow2 refers to an imaginary straight line through the center of rotation of the second eccentric portion 56. The second rotational axis Ow2 maintains a fixed position relative to the vibrating body 351 and 451. That is, even when the vibrating body 351 and 451 moves, the second rotational axis Ow2 moves integrally with the vibrating body 351 and 451 and maintains the position relative to the vibrating body 351 and 451. The second rotational axis Ow2 may extend vertically.

To provide the function of the second rotational axis Ow2, the weight shaft 54 disposed on the second rotational axis Ow2 may be provided as in this exemplary embodiment. To provide the function of the second rotational axis Ow2, in another exemplary embodiment, a projection protruding along the second rotational axis Ow2 may be formed on either the second eccentric portion 56 or the vibrating body 351 and 451, and a groove with which the projection rotatably engages may be formed in the other.

The first rotational axis Ow1 and the second rotational axis Ow2 may be disposed perpendicular to the vibration direction (+X, −X). In this exemplary embodiment, the first rotational axis Ow1 and the second rotational axis Ow2 may extend vertically.

The connection axis Oh refers to an imaginary straight line through the point at which excitation force Fo is applied to the hanger body 351 and 451 by the vibration generated by the vibration module 50, 350, and 450. The connection axis Oh may be defined as a straight line that passes through the point of action of excitation force Fo and extends vertically. The connection axis Oh maintains a fixed position relative to the vibrating body 351 and 451. That is, even when the vibrating body 351 and 451 moves, the connection axis Oh moves integrally with the vibrating body 351 and 451 and maintains the position relative to the vibrating body 351 and 451.

FIGS. 2*a* to 3*d* illustrate the center m1 of mass of the first eccentric portion 55, the center m2 of mass of the second eccentric portion 56, the radius r1 of rotation of the center m1 of mass with respect to the first rotational axis Ow1, the radius r2 of rotation of the center m2 of mass with respect to the second rotational axis Ow2, the angular speed w of the first eccentric portion 55 around the first rotational axis Ow1, the angular speed w of the second eccentric portion 56 around the second rotational axis Ow2, the distance A1 between the center axis Oc and the first rotational axis Ow1, the distance A2 between the center axis Oc and the second rotational axis Ow2, and the distance B between the center axis Oc and the connection axis Oh.

Also, FIGS. 2*a* to 3*d* illustrate the direction of the centrifugal force F1 of the first eccentric portion 55 with respect to the first rotational axis Ow1 and the direction of the centrifugal force F2 of the second eccentric portion 56 with respect to the second rotational axis Ow2. The sum of the centrifugal force F1 and centrifugal force F2 is applied to the vibrating body 351 and 451. The excitation force Fo refers to a force applied to the hanger body 331 and 431 by the centrifugal forces F1 and F2.

The magnitude of the centrifugal force F1 is $m1 \cdot r1 \cdot w^2$, and the magnitude of the centrifugal force F2 is $m2 \cdot r2 \cdot w^2$. The centrifugal force F1 and the centrifugal force F2 are exerted on the vibrating body 351 and 451, and the points of action of the centrifugal force F1 and centrifugal force F2 are positioned on the first rotational axis Ow1 and second rotational axis O2, respectively.

Referring to FIG. 2*a*, FIG. 2*c*, FIG. 3*a*, and FIG. 3*c*, the centrifugal force F1 and the centrifugal force F2 are set to reinforce each other in the vibration direction (+X, −X). When the weight of the first eccentric portion 55 is off-centered to one side D1 in the vibration direction (+X, −X) from the first rotational axis Ow1, the weight of the second eccentric portion 56 is off-centered to the one side D1 with respect to the second rotational axis Ow2. When the first eccentric portion 55 generates a centrifugal force F1 toward one side D1 in the vibration direction (+X, −X) with respect to the first rotational axis Ow1, the second eccentric portion 56 generates a centrifugal force F2 toward the one side D1 with respect to the second rotational axis Ow2.

Referring to FIG. 2*b*, FIG. 2*d*, FIG. 3*b*, and FIG. 3*d*, the centrifugal force F1 and the centrifugal force F2 are set to offset each other in a direction (+Y, −Y) intersecting the vibration direction (+X, −X). When the weight of the first eccentric portion 55 is off-centered to one side D2 in the direction (+Y, −Y) intersecting the vibration direction (+X, −X) with respect to the first rotational axis Ow1, the weight of the second eccentric portion 56 is off-centered to the opposite side of the one side D2 from the second rotational axis Ow2. When the first eccentric portion 55 generates a centrifugal force F1 toward one side D2 in the direction (+Y, −Y) intersecting the vibration direction (+X, −X) with respect to the first rotational axis Ow1, the second eccentric portion 56 generates a centrifugal force F2 toward the opposite side of the one side D2 with respect to the second rotational axis Ow2. Here, the intersecting direction (+Y, −Y) is a direction perpendicular to the vibration direction (+X, −X) and the rotational axis Ow1 and Ow2.

The centrifugal force F1 and the centrifugal force F2 are set to offset each other when they generate no excitation force Fo in a predetermined vibration direction (+X, −X). In this case, the centrifugal force F1 and the centrifugal force F2 act in opposite directions, and therefore the sum of the centrifugal forces F1 and F2 is equal to the difference between the magnitude of the centrifugal force F1 and the magnitude of the centrifugal force F2. Thus, at least one of the centrifugal forces F1 and F2 is offset by the other.

Preferably, the centrifugal force F1 and the centrifugal force F2 are set to "completely offset" each other when they generate no excitation force Fo in a predetermined vibration direction (+X, −X). The centrifugal force of the first eccentric portion and the centrifugal force of the second eccentric portion are set to completely offset each other in the direction (+Y, −Y) intersecting the vibration direction (+X, −X). Here, the expression "completely offset" means that the sum of the centrifugal force F1 and centrifugal force F2 is zero. This can minimize unnecessary vibrations generated in a direction (+Y, −Y) perpendicular to a predetermined vibration direction (+X, −X).

In order for the centrifugal force F1 and the centrifugal force F2 to completely offset each other when they generate no excitation force Fo in the vibration direction (+X, −X), the scalar quantity m1·r1 and the scalar quantity m2·r2 may be set equal.

i) The radius r1 of rotation of the center m1 of mass of the first eccentric portion 55 with respect to the first rotational axis Ow1; and ii) the radius r2 of rotation of the center m2 of mass of the second eccentric portion 56 with respect to the second rotational axis Ow2 may be set equal (r1=r2). The mass m1 of the first eccentric portion 55 and the mass m2 of the second eccentric portion 56 may be set equal (m1=m2). By these two settings (r1=r2, m1=m2), the centrifugal force F1 and centrifugal force F2 in the intersecting direction (+Y, −Y) may completely offset each other. Even if the radius r1 of rotation and the radius r2 of rotation are different and the mass m1 and the mass m2 are different, the settings r1=r2 and m1=m2 allow the centrifugal force F1 and centrifugal force F2 in the intersecting direction (+Y, −Y) to completely offset each other.

i) the distance A1 between the first rotational axis Ow1; and ii) the center axis Oc and the distance A2 between the second rotational axis Ow2 and the center axis Oc may be set equal. Through this, the centrifugal force F1 and centrifugal force F2 contribute to the generation of excitation force Fo in equal proportions, thereby preventing fatigue load from concentrating on either the region supporting the first eccentric portion 55 or the region supporting the second eccentric portion 56.

The first eccentric portion 55 and the second eccentric portion 56 may be configured to rotate at the same angular speed. i) The angular speed w of the first eccentric portion 55 around the first rotational axis Ow1; and ii) the angular speed w of the second eccentric portion 56 around the second rotational axis Ow2 may be set equal. This allows for periodic reinforcement and offsetting of the centrifugal forces F1 and F2 caused by the rotation of the first eccentric portion 55 and second eccentric portion 56.

Here, the angular speed refers to a scalar which only has magnitude but no direction of rotation, which is different from angular velocity which is a vector having both direction of rotation and magnitude. That is, if the angular speed w of the first eccentric portion 55 and the angular speed w of the second eccentric portion 56 are equal, this does not mean that they rotate in the same direction. In this exemplary embodiment, even if the angular speed w of the first eccentric portion 55 and the angular speed w of the second eccentric portion 56 are equal, the first eccentric portion 55 and the second eccentric portion 56 rotate in opposite directions.

Hereinafter, the operating mechanism of the vibration module 350 according to the first exemplary embodiment will be described below in more concrete details with reference to FIGS. 2*a* to 2*d*. The vibrating body 351 is configured to rotate around a predetermined center axis Oc where the position relative to the frame 10 is fixed.

In the first exemplary embodiment, the center axis Oc refers to an imaginary straight line through the center of rotation of the vibration module 350. The center axis Oc is an imaginary straight line that maintains a fixed position relative to the frame 10. The center axis Oc may extend vertically.

To provide the function of the center axis Oc, a center axial portion 375 protruding along the center axis Oc may be formed on the supporting member 370, and a central groove or hole with which the center axial portion 375 rotatably engages may be formed in the vibrating body 351, as in the first exemplary embodiment. To provide the function of the center axis Oc, in another exemplary embodiment, a projection protruding along the center axis Oc may be formed on the vibrating body 351, and a groove with which the projection rotatably engages may be formed in the supporting member 370.

In the first exemplary embodiment, the first rotational axis Ow1 and the second rotational axis Ow2 may be spaced apart from the center axis Oc in the same direction. Even if the first rotational axis Ow1 and the second rotational axis Ow2 are not the same, the reinforcement and offsetting of the centrifugal force F1 and the centrifugal force F2 may be repeated periodically, as long as the first rotational axis Ow1 and the second rotational axis Ow2 are placed apart from the center axis Oc in the same direction and the first eccentric portion 55 and the second eccentric portion 56 rotate at the same angular speed in opposite directions around the first rotational axis Ow1 and second rotational axis Ow2, respectively.

In the first exemplary embodiment, the center axis Oc, the first rotational axis Ow1, and the second rotational axis Ow2 are disposed to cross one imaginary straight line at a right angle.

In the first exemplary embodiment, the circumferential direction DI refers to the direction of a perimeter around the center axis Oc, and encompasses the clockwise direction DI1 and the counterclockwise direction DI2. In the first exemplary embodiment, the clockwise direction DI1 and the counterclockwise direction DI2 are defined as viewed from one of the directions (+Z, −Z) in which the center axis Oc extends.

When the centrifugal force F1 with respect to the first rotational axis Ow1 caused by the rotation of the first eccentric portion is directed in the circumferential direction DI, the centrifugal force F1 causes a rotation of the vibrating body 351 on the center axis Oc. Likewise, when the centrifugal force F2 with respect to the second rotational axis Ow2 caused by the rotation of the second eccentric portion 56 is directed in the circumferential direction DI, the centrifugal force F2 causes a rotation of the vibrating body 351 on the center axis Oc.

In the first exemplary embodiment, the diametrical direction Dr refers to a direction across the center axis Oc, and encompasses the centrifugal direction Dr1 and the mesial direction Dr2. The centrifugal direction Dr1 refers to a direction away from the center axis Oc, and the mesial direction Dr2 refers to a direction toward the center axis Oc.

When the centrifugal force F1 with respect to the first rotational axis Ow1 caused by the rotation of the first eccentric portion 55 is directed in the diametrical direction Dr, the centrifugal force F1 causes no rotation of the vibrating body 351 on the center axis Oc. Likewise, when the centrifugal force F2 with respect to the second rotational axis Ow2 caused by the rotation of the second eccentric portion 56 is directed in the diametrical direction Dr, the centrifugal force F2 causes no rotation of the vibrating body 351 on the center axis Oc.

In the first exemplary embodiment (see FIG. 7), the connection axis Oh and the center axis Oc are placed apart in parallel with each other. A protruding portion 358*a* is formed along the connection axis Oh at a connection point between the vibration module 350 and the hanger body 331 so that the rotating and reciprocating motion (arc motion) of the vibration module 350 is converted into the linear reciprocating motion of the hanger body 331.

In the first exemplary embodiment, since the vibration module 350 rotates around the center axis Oc, the excitation fore Fo can be calculated by converting the sum of the centrifugal force F1 and centrifugal force F2 into an external force with a point of action on the connection axis Oh, taking the moment arm lengths A1, A2, and B into account.

Figure 2A:
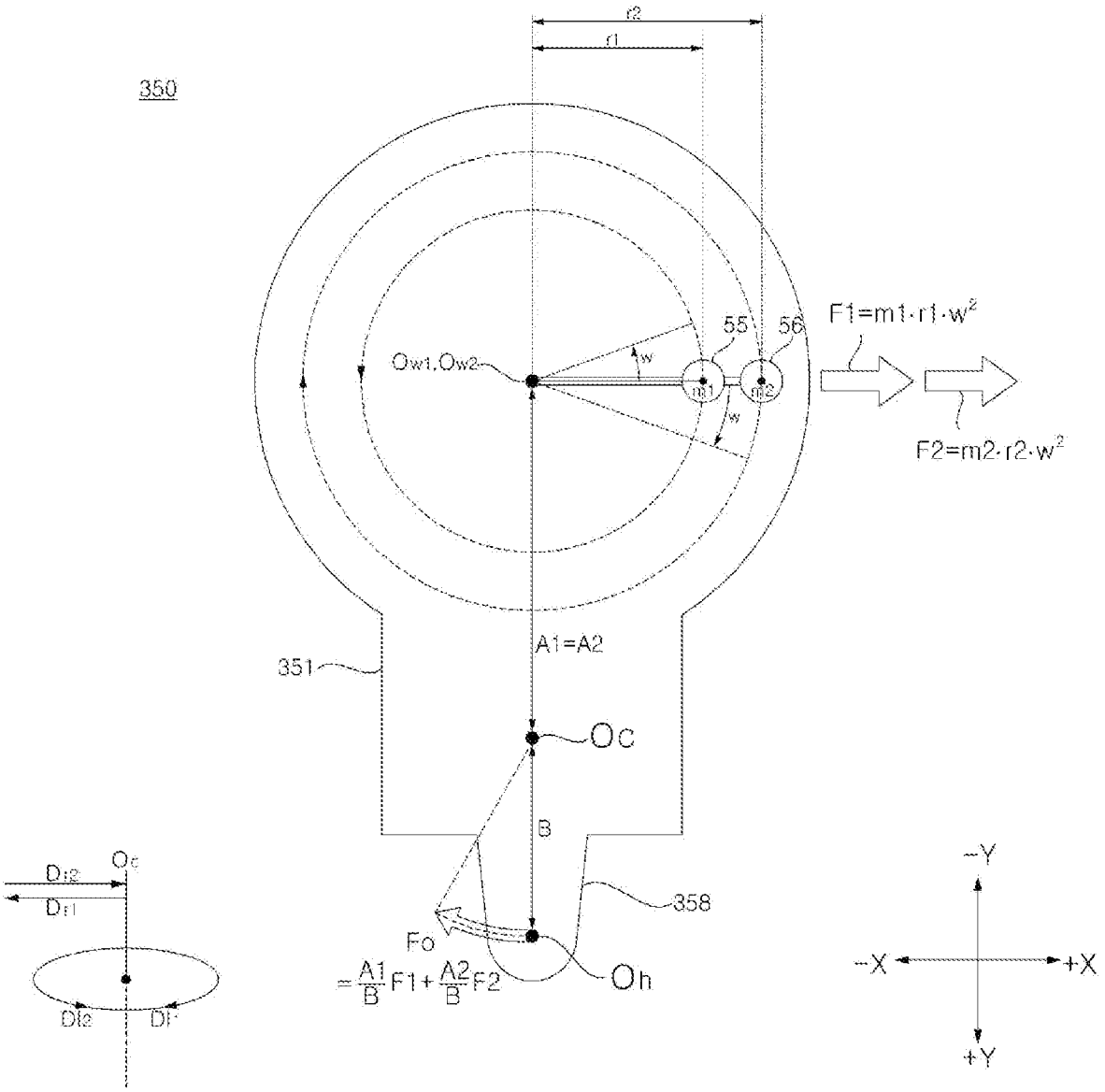
Figure 2B:
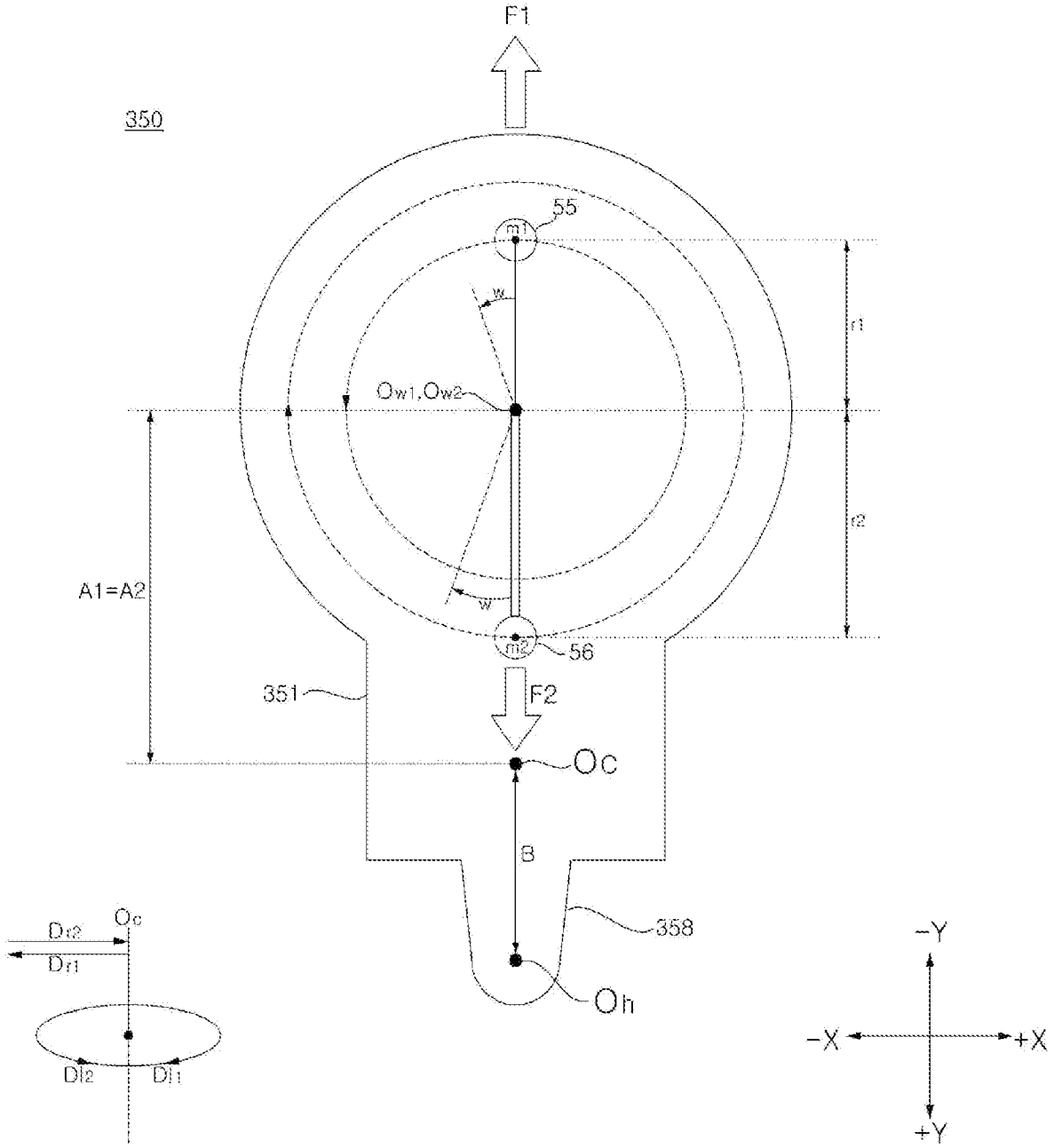
Figure 2C:
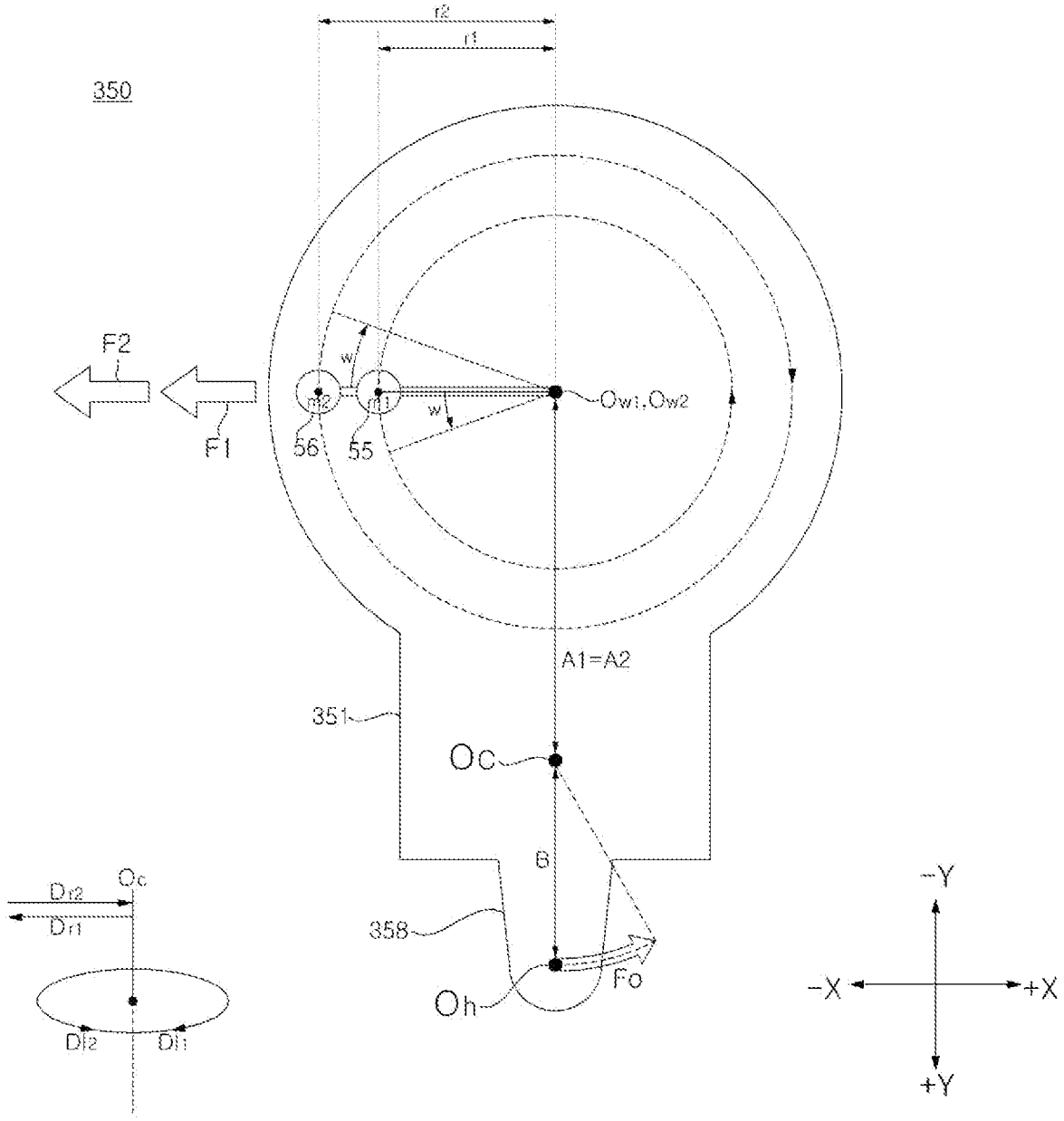

Referring to FIGS. 2*a* and 2*c*, the centrifugal force F1 and the centrifugal force F2 are set to reinforce each other when they generate a torque around the center axis Oc of the vibrating body 351. When the weight of the first eccentric portion 55 is off-centered in one direction D3, either clockwise direction DI1 or counterclockwise direction DI2 with respect to the center axis Oc, from the first rotational axis Ow1, the weight of the second eccentric portion 56 is off-centered in the one direction D3 from the second rotational axis Ow2. When the first eccentric portion 55 generates a centrifugal force in one direction D3, either clockwise direction DI1 or counterclockwise direction DI2 with respect to the center axis Oc, from the first rotational axis Ow1, the second eccentric portion 56 generates a centrifugal force in the one direction D3 from the second rotational axis Ow2. In this case, the moment A1·F1+A2·F2 caused by the centrifugal force F1 and centrifugal force F2 is equal to the moment B·Fo caused by the excitation force Fo. Thus, Fo becomes A1/B·F1+A2/B·F2.

Figure 2D:
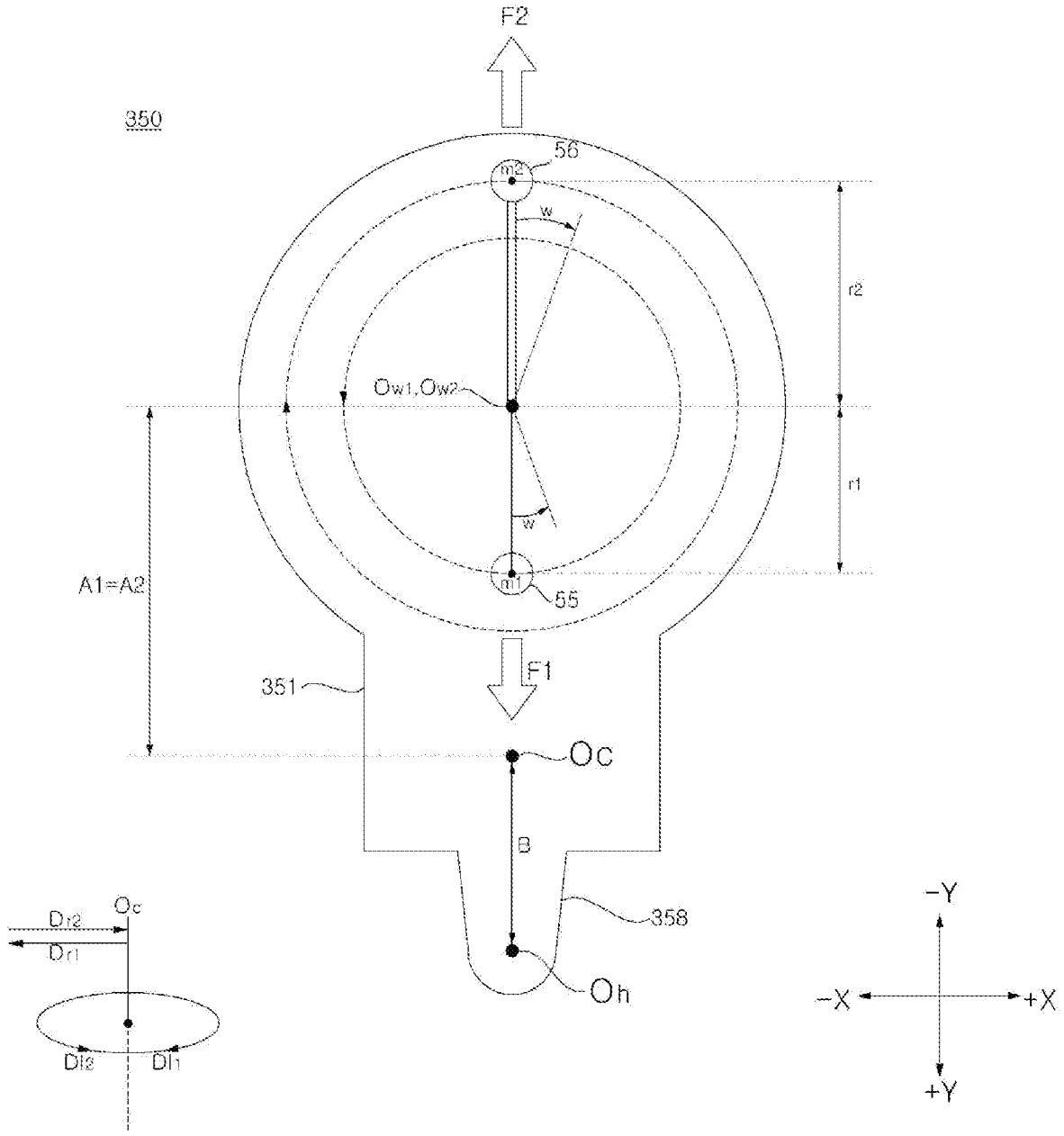

Referring to FIG. 2*b* and FIG. 2*d*, the centrifugal force F1 and the centrifugal force F2 are set to be directed in opposite directions when they generate no torque around the center axis Oc of the vibrating body 351. When the weight of the first eccentric portion 55 is off-centered in one direction D4, either centrifugal direction Dr1 or mesial direction Dr2 with respect to the center axis Oc, from the first rotational axis Ow1, the weight of the second eccentric portion 56 is off-centered in the opposite direction of the one direction D4 from the second rotational axis Ow2. When the first eccentric portion 55 generates a centrifugal force in one direction D4, centrifugal direction Dr1 or mesial direction Dr2 with respect to the center axis Oc, from the first rotational axis Ow1, the second eccentric portion 56 generates a centrifugal force in the opposite direction of the one direction D4 from the second rotational axis Ow2.

Referring to FIGS. 2*b* and 2*d*, when the centrifugal force F1 of the first eccentric portion 55 and the centrifugal force F2 of the second eccentric portion 56 offset each other, either the direction of action of the centrifugal force F1 or the direction of action of action of the centrifugal force F2 is the centrifugal direction Dr1, and the other is the mesial direction Dr2.

In the first exemplary embodiment, the centrifugal force F1 and the centrifugal force F2 are set to offset each other when they generate no torque for the vibrating body 351. In this case, the centrifugal force F1 and the centrifugal force F2 act in opposite directions, and therefore the sum of the centrifugal forces F1 and F2 is equal to the difference between the magnitude of the centrifugal force F1 and the magnitude of the centrifugal force F2. Thus, at least one of the centrifugal forces F1 and F2 is offset by the other. Preferably, the centrifugal force F1 and the centrifugal force F2 are set to "completely offset" each other when they generate no torque for the vibrating body 351.

FIGS. 2*a* to 2*d* show the momentum of 90-degree rotation of the first eccentric portion 55 and second eccentric portion 56 rotating at the same angular speed w.

Referring to FIG. 2*a*, when the first eccentric portion 55 generates a centrifugal force F1 with respect to the first rotational axis Ow1 in the clockwise direction DI1, the second eccentric portion 56 generates a centrifugal force F2 with respect to the second rotational axis Ow2 in the clockwise direction DI1. When the first eccentric portion 55 generates a centrifugal force F1 with respect to the first rotational axis Ow1 in the +X axis direction, the second eccentric portion 56 generates a centrifugal force F2 with respect to the second rotational axis Ow2 in the +X axis direction. Therefore, the centrifugal force F1 and the centrifugal force F2 reinforce each other, thereby generating a torque for the vibrating body 51 in the clockwise direction DI1. The excitation force Fo transmitted to the hanger body 331 along the connection axis Oh acts in the −X axis direction.

Referring to FIG. 2*b*, when the first eccentric portion 55 generates a centrifugal force F1 with respect to the first rotational axis Ow1 in the centrifugal direction Dr1, the second eccentric portion 56 generates a centrifugal force F2 with respect to the second rotational axis Ow2 in the mesial direction Dr2. When the first eccentric portion 55 generates a centrifugal force F1 with respect to the first rotational axis Ow1 in the −Y axis direction, the second eccentric portion 56 generates a centrifugal force F2 with respect to the second rotational axis Ow2 in the +Y axis direction. Therefore, the centrifugal force F1 and the centrifugal force F2 generate no torque for the vibrating body 51. The excitation force Fo transmitted to the hanger body 331 along the connection axis Oh is zero. Also, the centrifugal force F1 and the centrifugal force F2 are offset as they act in opposite directions.

Referring to FIG. 2*c*, when the first eccentric portion 55 generates a centrifugal force F1 with respect to the first rotational axis Ow1 in the counterclockwise direction DI2, the second eccentric portion 56 generates a centrifugal force F2 with respect to the second rotational axis Ow2 in the counterclockwise direction DI2. When the first eccentric portion 55 generates a centrifugal force F1 with respect to the first rotational axis Ow1 in the −X axis direction, the second eccentric portion 56 generates a centrifugal force F2 with respect to the second rotational axis Ow2 in the −X axis direction. Therefore, the centrifugal force F1 and the centrifugal force F2 reinforce each other, thereby generating a torque for the vibrating body 51 in the counterclockwise direction Dl2. The excitation force Fo transmitted to the hanger body 331 along the connection axis Oh acts in the +X axis direction.

Referring to FIG. 2*d*, when the first eccentric portion 55 generates a centrifugal force F1 with respect to the first rotational axis Ow1 in the mesial direction Dr2, the second eccentric portion 56 generates a centrifugal force F2 with respect to the second rotational axis Ow2 in the centrifugal direction Dr1. When the first eccentric portion 55 generates a centrifugal force F1 with respect to the first rotational axis Ow1 in the +Y axis direction, the second eccentric portion 56 generates a centrifugal force F2 with respect to the second rotational axis Ow2 in the −Y axis direction. Therefore, the centrifugal force F1 and the centrifugal force F2 generate no torque for the vibrating body 51. The excitation force Fo transmitted to the hanger body 331 along the connection axis Oh is zero. Also, the centrifugal force F1 and the centrifugal force F2 are offset as they act in opposite directions.

Hereinafter, the operating mechanism of the vibration module 450 according to the second exemplary embodiment will be described below in more concrete details with reference to FIGS. 3*a* to 3*d*. The vibrating body 451 is configured to be fixed to the hanger body 331 and move integrally with the hanger body 331.

In the second exemplary embodiment (see FIG. 11), when viewed from the direction in which the rotational axis Ow1 and Ow2 extends, the connection axis Oh may be disposed between the center Mm of mass of the motor 52 and the rotational axis Ow1 and Ow2. When viewed from the direction (top) in which the first rotational axis Ow1 extends, the hanger driving unit 458 is fixed to the hanger body 431, in a position between the center Mm of mass of the motor 52 and the first rotational axis Ow1. This can reduce torsion caused by the center Mm of mass of the motor 52 when an excitation force is transmitted to the hanger body 431 from the vibration module 450, thereby creating more stable vibrating motion.

In the second exemplary embodiment, since the vibration module 450 vibrates integrally with the hanger body 431, the excitation fore Fo can be calculated as the sum of the centrifugal force F1 and centrifugal force F2 in the vibration direction (+X, −X).

Figure 3A:
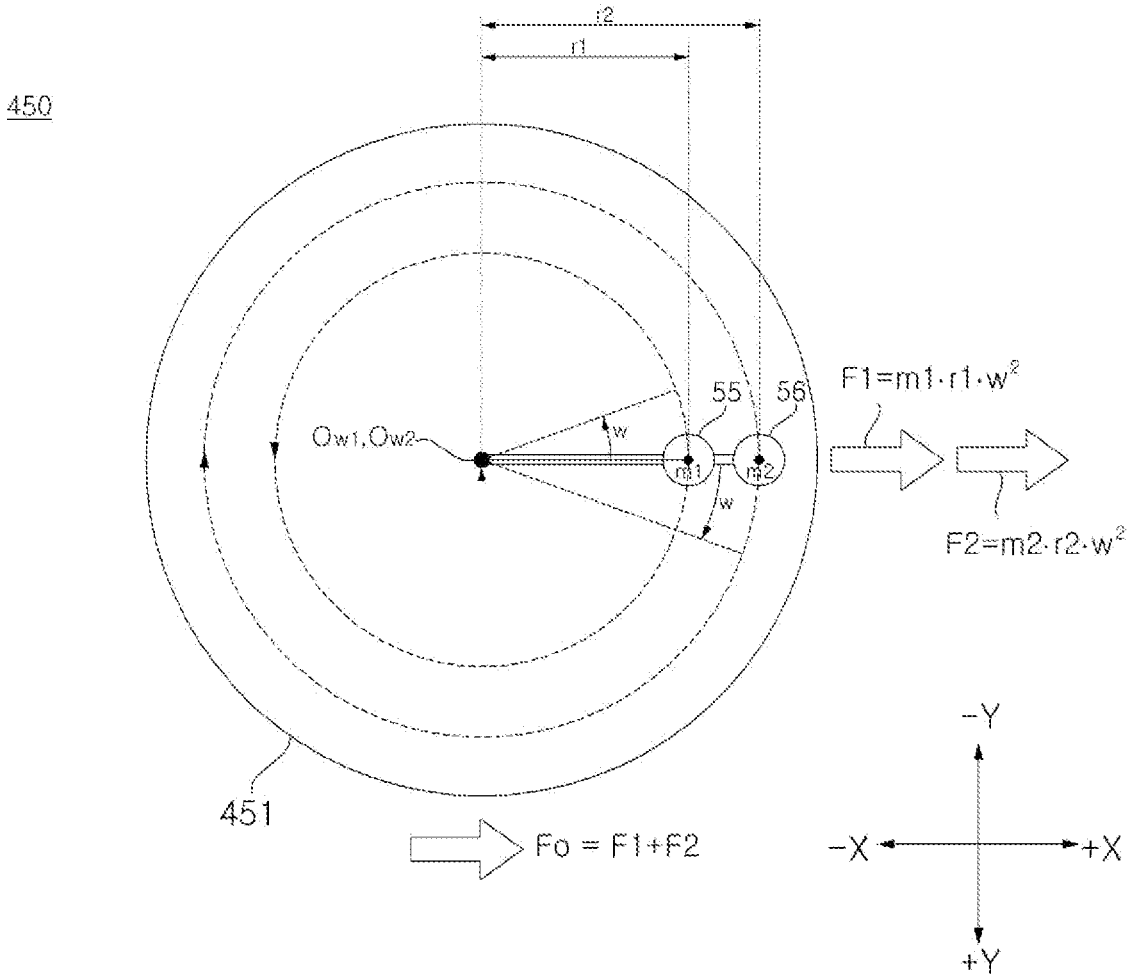
Figure 3B:
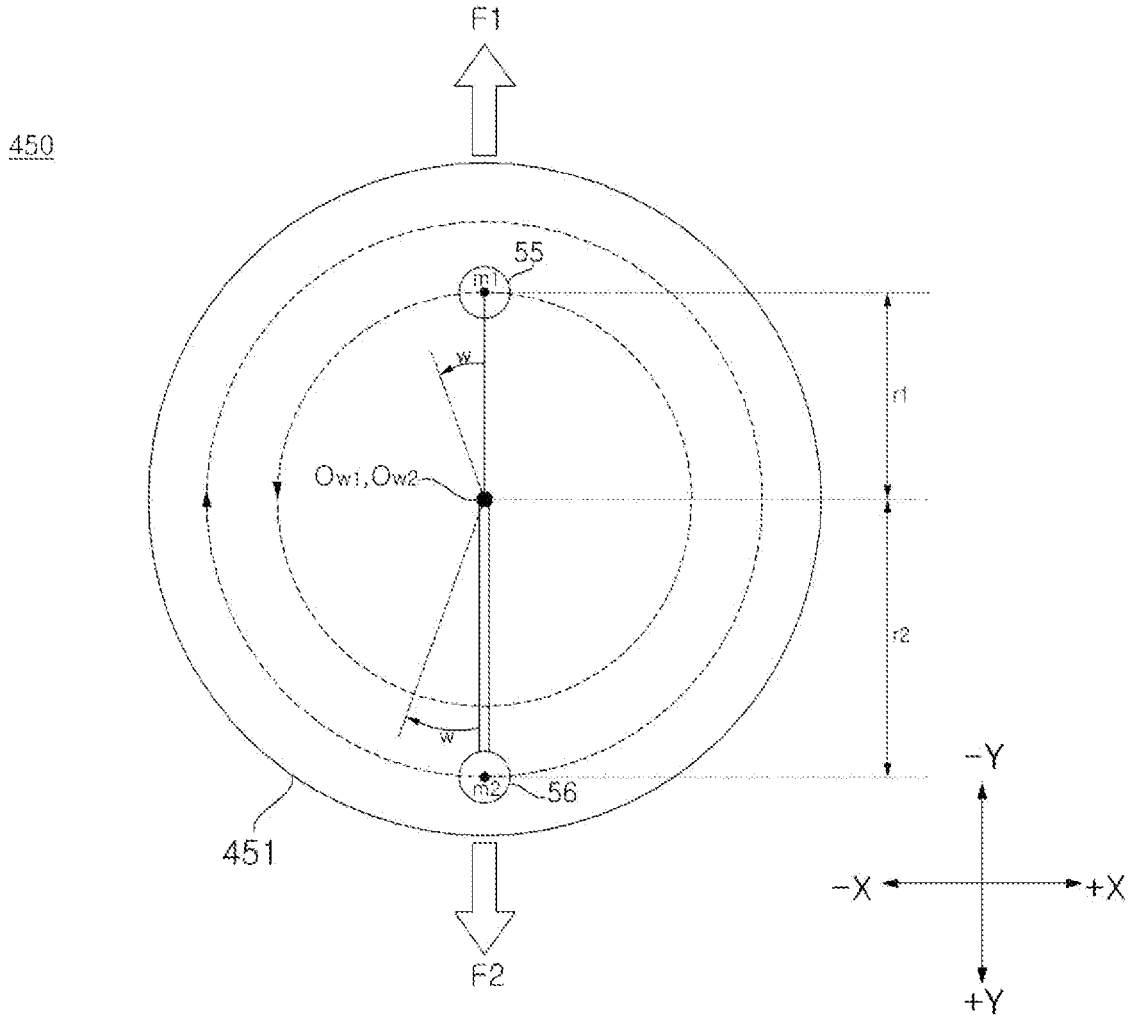
Figure 3C:
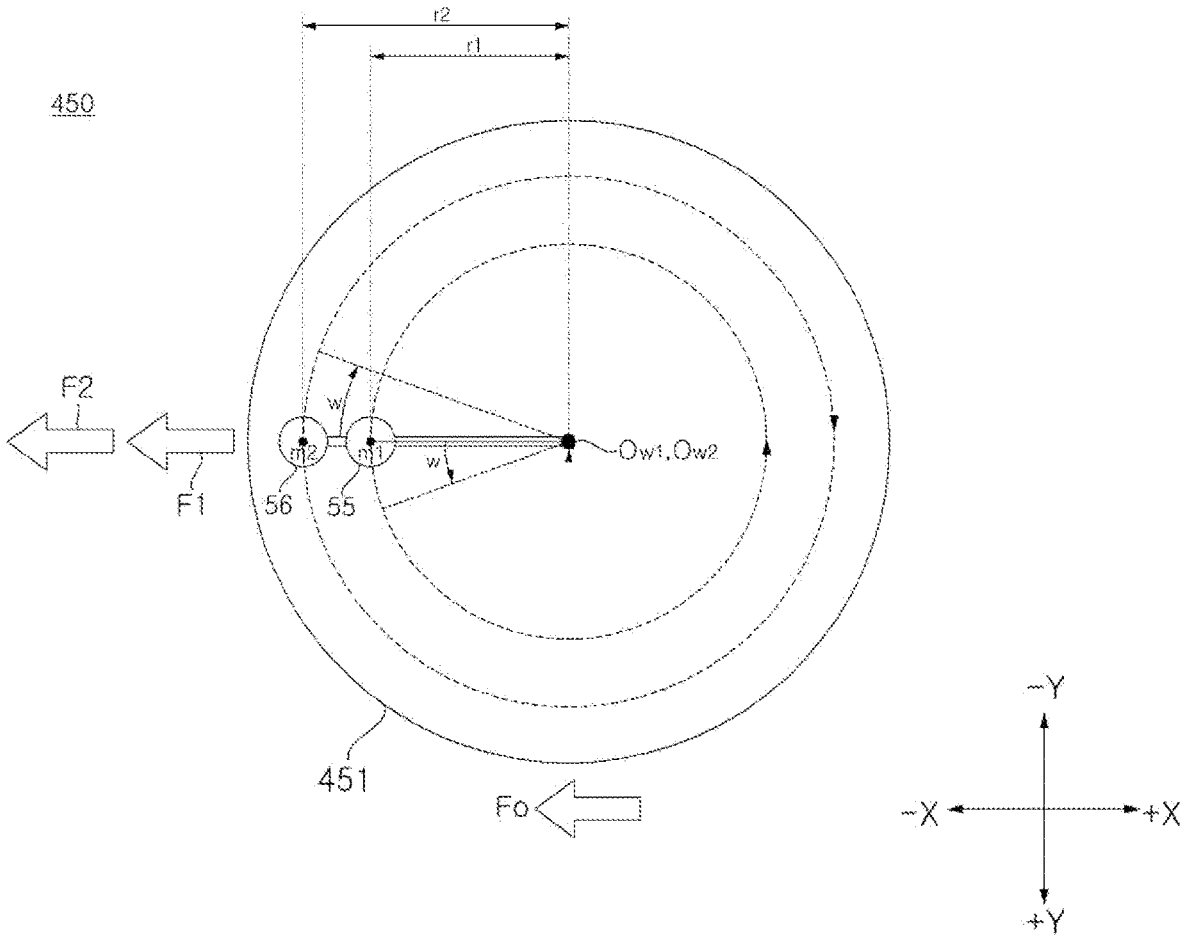

Referring to FIG. 3*a* and FIG. 3*c*, the centrifugal force F1 and the centrifugal force F2 are set to reinforce each other when exerted on the vibrating body 351 in the vibration direction (+X, −X). In this case, the excitation force Fo in the vibration direction (+X, −X) caused by the centrifugal force F1 and centrifugal force F2 is F1+F2.

Figure 3D:
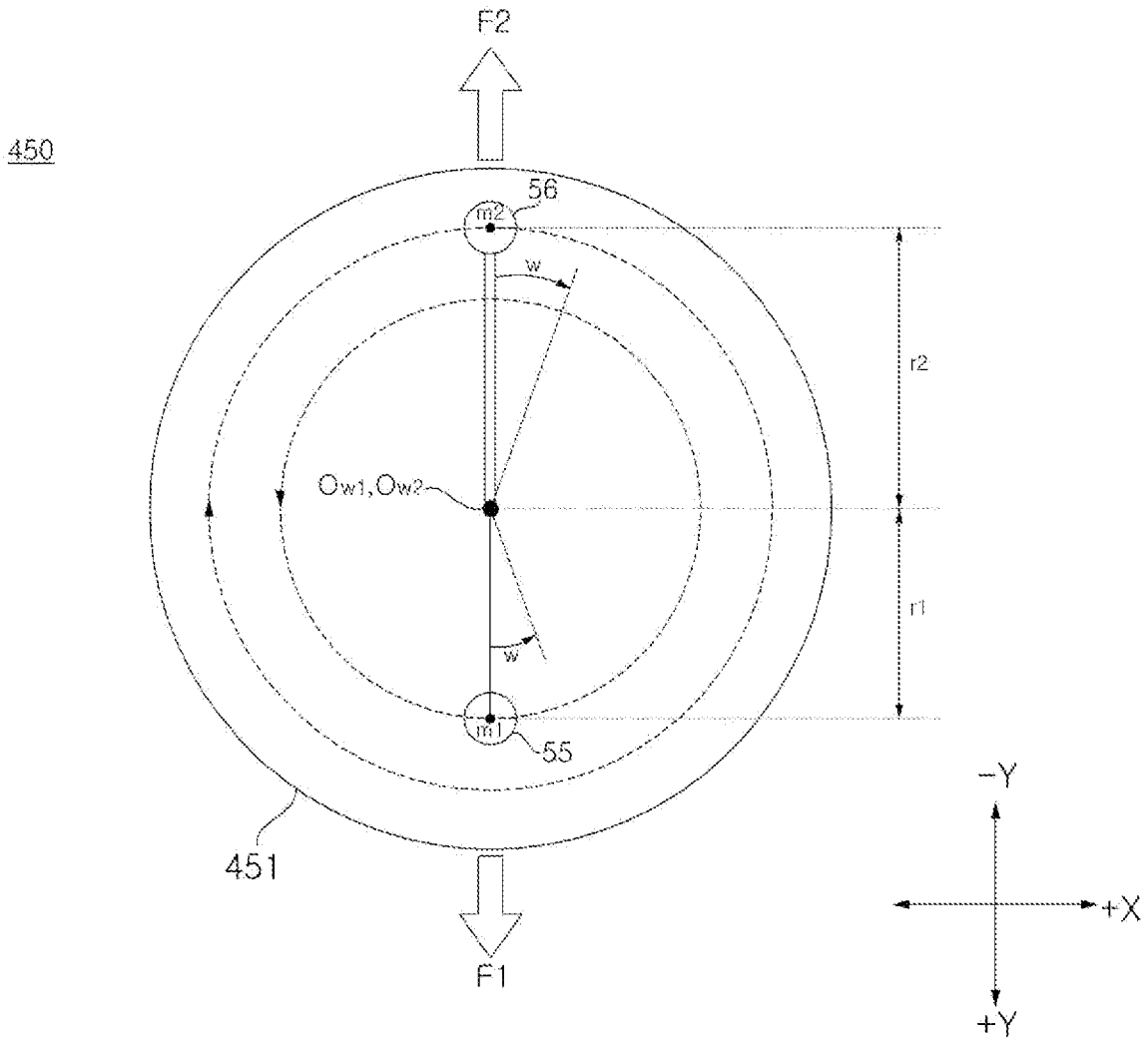

Referring to FIG. 3*b* and FIG. 3*d*, the centrifugal force F1 and the centrifugal force F2 are set to be directed in opposite directions when exerted on the vibrating body 351 in the intersecting direction (+Y, −Y). In this case, the excitation force Fo in the vibration direction (+X, −X) caused by the centrifugal force F1 and centrifugal force F2 is zero. Also, the excitation force in the intersecting direction (+Y, −Y) caused by the centrifugal force F1 and centrifugal force F2 is |F1-F2|. Preferably, the excitation force in the intersecting direction (+Y, −Y) caused by the centrifugal force F1 and centrifugal force F2 is preset to zero.

FIGS. 3*a* to 3*d* show the angular momentum of 90-degree rotation of the first eccentric portion 55 and second eccentric portion 56 rotating at the same angular speed w.

Referring to FIG. 3*a*, when the first eccentric portion 55 generates a centrifugal force F1 with respect to the first rotational axis Ow1 in the +X axis direction, the second eccentric portion 56 generates a centrifugal force F2 with respect to the second rotational axis Ow2 in the +X axis direction. Therefore, the centrifugal force F1 and the centrifugal force F2 reinforce each other and act on the vibrating body 51 in the +X axis direction. The excitation force Fo transmitted to the hanger body 331 acts in the +X axis direction.

Referring to FIG. 3*b*, when the first eccentric portion 55 generates a centrifugal force F1 with respect to the first rotational axis Ow1 in the −Y axis direction, the second eccentric portion 56 generates a centrifugal force F2 with respect to the second rotational axis Ow2 in the +Y axis direction. Therefore, the centrifugal force F1 and the centrifugal force F2 do not act on the vibrating body 51 in the vibration direction (+X, −X). Also, the centrifugal force F1 and the centrifugal force F2 in opposite directions offset each other. The excitation force Fo in the vibration direction (+X, −X) transmitted to the hanger body 331 is zero.

Referring to FIG. 3*c*, when the first eccentric portion 55 generates a centrifugal force F1 with respect to the first rotational axis Ow1 in the −X axis direction, the second eccentric portion 56 generates a centrifugal force F2 with respect to the second rotational axis Ow2 in the −X axis direction. Therefore, the centrifugal force F1 and the centrifugal force F2 reinforce each other and act on the vibrating body 51 in the −X axis direction. The excitation force Fo transmitted to the hanger body 331 acts in the −X axis direction.

Referring to FIG. 3*d*, when the first eccentric portion 55 generates a centrifugal force F1 with respect to the first rotational axis Ow1 in the +Y axis direction, the second eccentric portion 56 generates a centrifugal force F2 with respect to the second rotational axis Ow2 in the −Y axis direction. Therefore, the centrifugal force F1 and the centrifugal force F2 do not act on the vibrating body 51 in the vibration direction (+X, −X). Also, the centrifugal force F1 and the centrifugal force F2 in opposite directions offset each other. The excitation force Fo in the vibration direction (+X, −X) transmitted to the hanger body 331 is zero.

Figure 4:
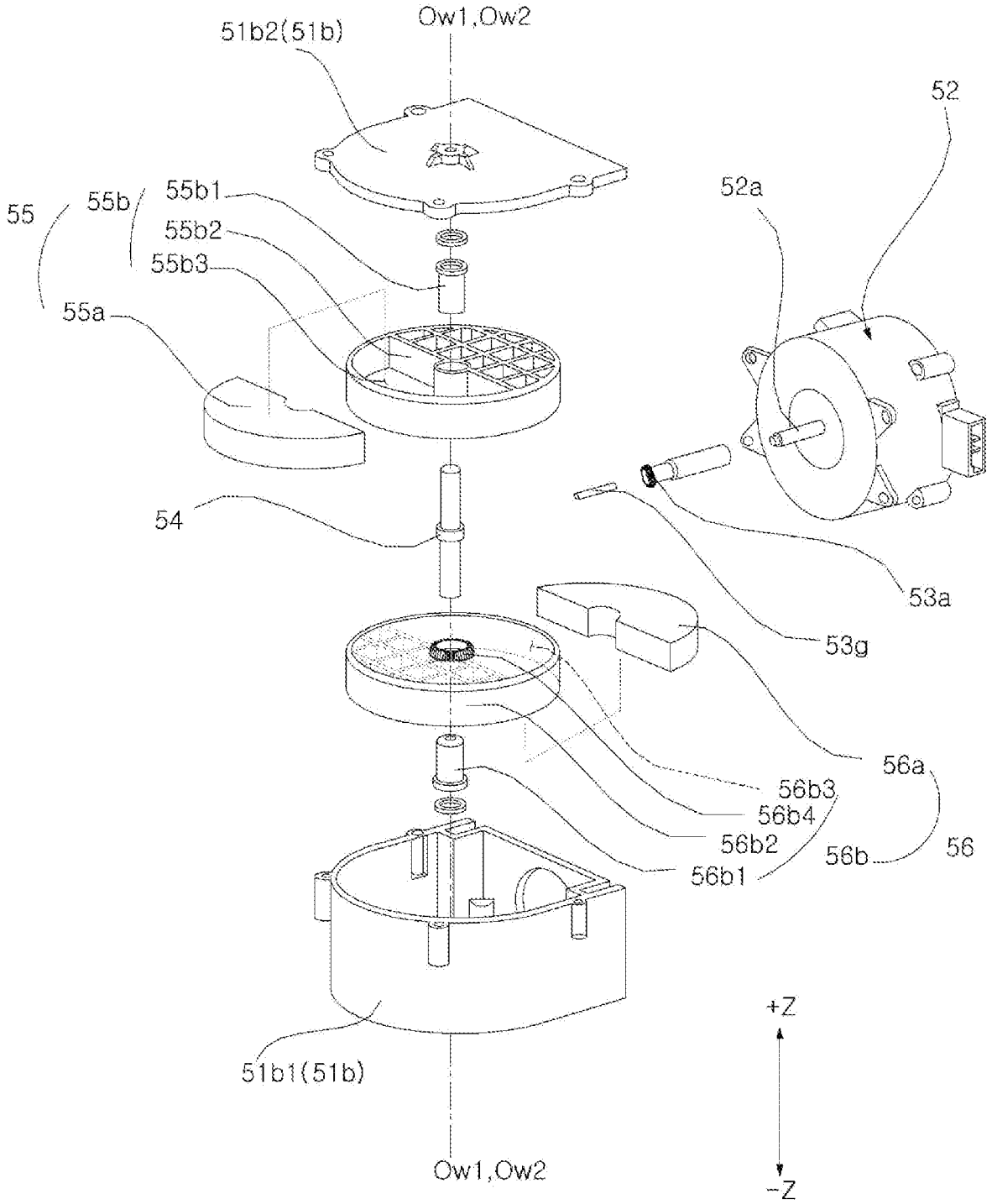
FIG. 4 is an exploded perspective view of an operating structure of an exemplary embodiment of the first eccentric portion 55 and second eccentric portion 56 of the vibration module 350 and 450 of FIGS. 2*a* to 3*d*.

Referring to FIGS. 4 and 5, a description of the elements common to the first and second exemplary embodiments is the same as what has been described above. Hereinafter, a description will given, focusing on the elements different for the first and second exemplary embodiments.

Hereinafter, the configuration of the vibration module 350, elastic member 360, and supporting member 370 according to the first exemplary embodiment will be described with reference to FIGS. 6 to 9. The vibrating body 351 according to the first exemplary embodiment is configured to be rotatable around the center axis Oc.

In the first exemplary embodiment, the weight casing 51*b* is placed apart from the center axis Oc in the centrifugal direction Dr1. The weight casing 51*b* and the hanger driving unit 458 may be placed apart from each other, in opposite directions with respect to the center axis Oc. The connection axis Oh and the rotational axis Ow1 and Ow2 may be placed apart from each other, in opposite directions with respect to the center axis Oc. The motor 52 may be disposed between the center axis Oc and the rotational axis Ow1 and Ow2. The motor shaft 52*a* may protrude in the centrifugal direction Dr1. The motor shaft 52*a* may protrude in the −Y axis direction.

The vibrating body 351 may comprise a base casing 351*d* rotatably supported by the center axial portion 375. The center axial portion 375 is placed to penetrate the base casing 351*d*. A bearing B is interposed between the center axial portion 375 and the base casing 351*d*. The base casing 351*d* is disposed between the weight casing 51*b* and an elastic member mount 351*c*.

The vibrating body 351 may comprise a motor supporting portion 351*e* supporting the motor 52. The motor supporting portion 351*e* may support the bottom end of the motor. The motor supporting portion 351*e* may be disposed between the weight casing 51*b* and the base casing 351*d*.

The vibrating body 351 may comprise an elastic member mount 351*c* on which one end of the elastic member 360 is locked. When the vibration module 350 rotates and vibrates, the elastic member mount 351*c* applies pressure on the elastic member 360 or receive restoring force from the elastic member 360.

The elastic member mount 351*c* may be disposed on one end of the vibrating body 351 in the centrifugal direction Dr1. The elastic member mount 351*c* may connect and extend between the center axis Oc and the connection axis Oh. The elastic member mount 351*c* may extend in the centrifugal direction DO and therefore have a distal end. The elastic member mount 351*c* is disposed on the other side of the first and second rotational axes Ow1 and Ow2 with respect to the center axis Oc. The elastic member mount 351*c* may be fixed to the base casing 351*d*. The elastic member mount 351*c*, base casing 351*d*, and motor supporting portion 351*e* may be formed as a single unit.

In the first exemplary embodiment, the motor 52 may be placed apart from the center axis Oc. The motor 52 may be disposed between the center axis Oc and the first and second rotational axes Ow1 and Ow2. The motor 52 has a motor shaft 52*a* placed perpendicular to the center axis Oc. The motor shaft 52*a* may protrude from the motor in the centrifugal direction Dr1.

The hanger driving unit 358 is connected to the hanger body 331, spaced apart from the center axis Oc. The hanger driving unit 358 may be configured to be connected to the hanger body 331 on the outside, spaced apart from the center axis Oc.

The hanger driving unit 358 may comprise a protruding portion 358*a* that protrudes along the connection axis Oh. The protruding portion 358*a* protrudes downward from the hanger driving unit 358. The protruding portion 358*a* protrudes along the connection axis Oh. The hanger driving unit 358 may comprise a connecting rod 358*a* and 358*b* comprising the protruding portion 358*a*. The connecting rod 358*a* and 358*b* may be configured as a separate member. One end 358*a* of the connecting rod 358*a* and 358*b* may be inserted into a slit 331*bh* of the hanger driven unit 331*b*. The connecting rod 358*a* and 358*b* converts the rotating motion of the vibration module 350 to reciprocate the hanger body 331.

The connecting rod 358*a* and 358*b* is fixed to the vibrating body 351. The upper end of the connecting rod 358*a* and 358*b* may be fixed to the vibrating body 351. The connecting rod 358*a* and 358*b* rotates integrally with the vibrating body 351. The connecting rod 358*a* and 358*b* may be disposed on the connection axis Oh. The connecting rod 358*a* and 358*b* may transmit the torque of the vibrating body 351 to the hanger body 331.

The connecting rod 358*a* and 358*b* may comprise a vertical extension 358*b* which extends in an up-down direction. The vertical extension 358*b* may extend along the connection axis Oh. The upper end of the vertical extension 358*b* may be fixed to the elastic member mount 351*c*. The connecting rod 358*a* and 358*b* comprises the protruding portion 358*a* formed at the distal end of the vertical extension 358*b*. The protruding portion 358*a* is disposed on the lower end of the vertical extension 358*b*.

The vibration module 350 comprises an elastic member locking portion 359 on which one end of the elastic member 360 is locked. When the vibration module 350 rotates around the center axis Oc, the elastic member 360 is elastically deformed by the elastic member locking portion 359, or the restoring force of the elastic member 360 is transmitted to the elastic member locking portion 359. The elastic member locking portion 359 is disposed on the elastic member mount 351*c*.

The elastic member locking portion 359 may comprise a first locking portion 359*a* on which one end of the first elastic member 360*a* is locked. The first locking portion 359*a* may be formed on one side (+X) of the elastic member mount 351*c*. The elastic member locking portion 359 may comprise a second locking portion 359*b* on which one end of the second elastic member 360*b* is locked. The second locking portion 359*b* may be formed on the other side (−X) of the elastic member mount 351*c*.

The elastic member 360 may be disposed between the vibration module 350 and the supporting member 370. One end of the elastic member 460 is locked on the vibration module 350, and the other end is locked on an elastic member mounting portion 377 of the supporting member 370. The elastic member 360 may comprise a tension spring and/or a compression spring. A pair of elastic members 360*a* and 360*b* may be disposed on both sides of the connection axis Oh in the vibration direction (+X, −X). The elastic member 360 may be placed apart from the center axis Oc.

A plurality of elastic members 360*a* and 360*b* may be provided. The elastic members 360*a* and 360*b* each may be configured to elastically deform when the vibration module 350 moves in either the clockwise direction DI1 or the counterclockwise direction DI2 and regain their elasticity when it moves in the other direction. The elastic members 360*a* and 360*b* may be configured to elastically deform when the hanger body 331 moves to one side in the vibration direction (+X, −X) and regain their elasticity when it moves to the other side.

The first elastic member 360*a* is disposed on one side (+X) of the vibrating body 351. One end of the first elastic member 360*a* may be locked on the first locking portion 359*a*, and the other end may be locked on a first mounting portion 377*a* of the supporting member 370. The first elastic member 360*a* may comprise a spring that elastically deforms in the vibration direction (+X, −X) and regains its elasticity.

The second elastic member 360*b* is disposed on the other side (−X) of the vibrating body 351. The elastic member mount 351*c* is disposed between the first elastic member 360*a* and the second elastic member 360*b*. One end of the second elastic member 360*b* may be locked on the second locking portion 359*b*, and the other end may be locked on a second mounting portion 377*b* of the supporting member 370. The second elastic member 360*b* may comprise a spring that elastically deforms in the vibration direction (+X, −X) and regains its elasticity.

The supporting member 370 may comprise a center axial portion 375 protruding along the center axis Oc. The center axial portion 375 may protrude upward from a center axis supporting portion 376. The center axial portion 375 is inserted into a hole formed in the vibrating body 351. The center axial portion 375 rotatably supports the vibrating body 351 through a bearing B.

The supporting member 370 may comprise a center axial supporting portion 376 to which the center axial portion 375 is fixed. The center axial supporting portion 376 may be located a distance below the vibrating body 351. The center axial supporting portion 376 is fixed to the frame 10.

The supporting member 370 comprises an elastic member mounting portion 377 where one end of the elastic member 360 is fixed. The elastic member mounting portion 377 is fixed to the frame 10. The elastic member mounting portion 377 may be fixed to the interior frame 11*a*. The first mounting portion 377*a* and the second mounting portion 377*b* are placed apart from each other, in opposite directions with respect to the connection axis Oh.

Hereinafter, the configuration of the vibration module 450, elastic member 460, and supporting member 470 according to the second exemplary embodiment will be described with reference to FIGS. 10 to 12. The vibrating body 451 according to the second exemplary embodiment is configured to be fixed to the hanger body 431 and move integrally with the hanger body 431.

The vibrating body 451 comprises a weight casing 51*b*. The vibrating body 451 supports the motor 52. The weight casing 51*b* may be disposed in front of the motor 52. The motor shaft 52*a* may protrude forward. The connection axis Oh is disposed between the rotational axis Ow1 and Ow2 and the center Mm of mass of the motor 52.

The hanger driving unit 458 connects and holds the vibrating body 451 and the hanger body 431 together. The hanger driving unit 458 is fixed to the vibrating body 451. The hanger driving unit 458 may protrude and extend downward from the vibrating body 451, so that the lower end is fixed to the hanger body 431. The lower end of the hanger driving unit 458 is fixed to the hanger driven unit 431*b*. The hanger driving unit 458 vibrates integrally with the hanger driven unit 431*b*.

The hanger driving unit 458 may be disposed on the connection axis Oh. The hanger driving unit 458 may be disposed between the rotational axis Ow1 and Ow2 and the center Mm of mass of the motor 52. When viewed from the direction in which the first rotational axis Ow1 extends, the hanger driving unit 458 is fixed to the hanger body, in a position between the center Mm of mass of the motor 52 and the first rotational axis Ow1.

The vibration module 450 comprises an elastic member locking portion 459 on which one end of the elastic member 460 is locked. When the vibration module 450 reciprocates to the left and right, the elastic member 460 is elastically deformed by the elastic member locking portion 459, or the restoring force of the elastic member 460 is transmitted to the elastic member locking portion 459. The elastic member locking portion 459 is disposed on the weight casing 51*b*.

The elastic member locking portion 459 may comprise a first locking portion 459*a* on which one end of the first elastic member 60*a* is locked. The first locking portion 459*a* may be formed on one side (+X) of the weight casing 51*b*. The elastic member locking portion 459 may comprise a second locking portion 459*b* on which one end of the second elastic member 460*b* is locked. The second locking portion 459*b* may be formed on the other side (−X) of the weight casing 51*b*.

The elastic member 460 may be disposed between the vibration module 450 and the supporting member 470. One end of the elastic member 460 is locked on the vibration module 450, and the other end is locked on an elastic member mounting portion 477 of the supporting member 470. The elastic member 460 may comprise a tension spring and/or a compression spring. A pair of elastic members 460*a* and 460*b* may be disposed on both sides of the connection axis Oh in the vibration direction (+X, −X).

A plurality of elastic members 460*a* and 460*b* may be provided. The elastic members 460*a* and 460*b* may be configured to elastically deform when the vibration module 450 moves to one side in the vibration direction (+X, −X) and regain their elasticity when it moves to the other side. The elastic members 460*a* and 460*b* may be configured to elastically deform when the hanger body 431 moves to one side in the vibration direction (+X, −X) and regain their elasticity when it moves to the other side.

The first elastic member 460*a* is disposed on one side (+X) of the vibrating body 451. One end of the first elastic member 460*a* may be locked on the first locking portion 459*a*, and the other end may be locked on a first mounting portion 477*a* of the supporting member 470. The first elastic member 460*a* may comprise a spring that elastically deforms in the vibration direction (+X, −x) and regains its elasticity.

The second elastic member 460*b* is disposed on the other side (−X) of the vibrating body 451. One end of the second elastic member 460*b* may be locked on the second locking portion 459*b*, and the other end may be locked on a second mounting portion 477*b* of the supporting member 470. The second elastic member 460*b* may comprise a spring that elastically deforms in the vibration direction (+X, −x) and regains its elasticity.

The supporting member 470 comprises an elastic member mounting portion 477 where one end of the elastic member 460 is fixed. The elastic member mounting portion 477 is fixed to the frame 10. The elastic member mounting portion 477 may be fixed to the interior frame 11*a*. The first mounting portion 477*a* and the second mounting portion 477*b* are placed apart from each other, in opposite directions with respect to the connection axis Oh.

The supporting member 470 may further comprise a module guide 478 that allows the vibration module 450 to move in the vibration direction (+X, −X) but restricts the movement in a direction (+Y, −Y) intersecting the vibration direction (+X, −X). The module guide 478 may make contact with the hanger driving unit 458 and guide the hanger driving unit 458 in the vibration direction (+X, −X). The module guide 478 may be disposed between the pair of mounting portions 477*a* and 477*b*. The module guide 478 may be disposed under the vibrating body 451. The module guide 478 may be formed in the shape of a horizontal plate. The module guide 478 is fixed to the frame 10.

What is claimed is:

1. A clothes treatment apparatus for treating clothes in a treatment space comprising:

an exterior frame forming an outer side of the clothes treatment apparatus;

a frame disposed in the exterior frame, wherein at least part of the frame is located above the treatment space;

a hanger body configured to move with respect to the frame and provided to hang clothes or clothes hangers;

a center axial portion configured to be fixed with respect to the frame, and disposed along a center axis extending in the vertical direction;

a first eccentric portion configured to rotate in a first direction around a first rotational axis spaced apart from the center axis, and having a center of mass spaced apart from the first rotational axis;

a second eccentric portion configured to rotate in a second direction opposite to the first direction around the first rotational axis, and having a center of mass spaced apart from the first rotational axis;

a motor generating a torque for rotating the first eccentric portion and second eccentric portion;

a vibrating body supporting rotatably the first eccentric portion and second eccentric portion, wherein the vibrating body moves clockwise or counterclockwise with respect to the center axis by a first centrifugal force generated by rotation of the first eccentric portion and a second centrifugal force generated by rotation of the second eccentric portion; and a hanger driving unit configured to connect the vibrating body and the hanger body, wherein the hanger driving unit transmits excitation force of the vibrating body to the hanger body.

2. The clothes treatment apparatus of claim 1, wherein the hanger body is configured to move with respect to the frame in a predetermined vibration direction (+X, −X), and the first centrifugal force and the second centrifugal force are set to reinforce each other in the vibration direction (+X, −X) and offset each other in a direction (+Y, −Y) intersecting the vibration direction (+X, −X).

3. The clothes treatment apparatus of claim 2, wherein the first centrifugal force and the second centrifugal force are set to completely offset each other in the direction (+Y, −Y) intersecting the vibration direction (+X, −X).

4. The clothes treatment apparatus of claim 1, wherein the hanger driving unit is disposed in a opposite side of the to the first rotation axis relative to the central axis.

5. The clothes treatment apparatus of claim 1, wherein:

the radius of rotation of the center of mass of the first eccentric portion with respect to the first rotational axis and the radius of rotation of the center of mass of the second eccentric portion with respect to the second rotational axis are set equal; and the first eccentric portion and the second eccentric portion are the same weight.

6. The clothes treatment apparatus of claim 1, wherein:

the motor has a motor shaft provided perpendicular to the central axis;

the first eccentric portion and the second eccentric portion are disposed each other vertically; and the apparatus further comprises a bevel gear rotating integrally with the motor shaft and transferring the torque of the motor shaft to the first eccentric part and the second eccentric part, respectively.

7. The clothes treatment apparatus of claim 6, wherein:

the first eccentric portion is disposed above the second eccentric portion;

the first eccentric portion comprises a first toothed portion engaged with the bevel gear; and the second eccentric portion comprises a second toothed portion engaged with the bevel gear.

8. The clothes treatment apparatus of claim 7, wherein the bevel gear is placed between the first eccentric portion and the second eccentric portion.

9. The clothes treatment apparatus of claim 1, wherein:

the first eccentric portion comprises a first weight member disposed away from the first rotational axis so that the center of mass of the first eccentric portion is eccentric; and the second eccentric portion comprises a second weight member disposed away from the first rotational axis so that the center of mass of the second eccentric portion is eccentric.

10. The clothes treatment apparatus of claim 1, further comprising:

an elastic member locking portion disposed at the vibrating body; and an elastic member having one end supported by the elastic member locking portion and another end supported by the support member, wherein the elastic member is elastically deformed when the vibration body moves.

11. The clothes treatment apparatus of claim 10, wherein the vibrating body comprises:

a base casing rotatably supported by the center axial portion; and an elastic member mount fixed to the base casing and supporting the elastic member.

12. The clothes treatment apparatus of claim 1, further comprising a hanger driven unit engaged with the hanger driving unit and the hanger body, and wherein the hanger driven unit has a slit that extends in a direction (+Y, −Y) intersecting the vibration direction (+X, −X), and the hanger driving unit has a protruding portion that protrudes in parallel with the center axis and is inserted into the slit.

13. The clothes treatment apparatus of claim 12, wherein the hanger driven unit is configured to convert the motion of the hanger driving unit moving integrally with the vibration body into a reciprocating motion and transfers the reciprocating motion to the hanger body.

14. The clothes treatment apparatus of claim 11, wherein the vibration body comprises a weight casing accommodating the first eccentric portion and the second eccentric portion.

15. The clothes treatment apparatus of claim 9, further comprising:

a bevel gear rotating integrally with a motor shaft of the motor, wherein the motor shaft is provided perpendicular to the central axis;

a first rotating portion holding the first weight member having a first toothed portion engaged with the bevel gear; and a second rotating portion holding the second weight member having a second toothed portion engaged with the bevel gear.

16. The clothes treatment apparatus of claim 15, wherein:

the first toothed portion is formed at lower side of the first rotating portion; and the second toothed portion is formed at upper side of the second rotating portion.

17. The clothes treatment apparatus of claim 1, wherein:

at a first time when the motor is driving, the first weight member and the second weight member are positioned to overlap each other in the vertical direction; and at a second time different from the first time point, the first weight member and the second weight member are positioned at positions that do not overlap in the vertical direction, respectively.

18. The clothes treatment apparatus of claim 1, wherein the center of mass of the second eccentric portion is disposed in opposite side of the center of mass of the first eccentric portion about the first rotational axis.

19. The clothes treatment apparatus of claim 9, wherein the second weight member is disposed in opposite side of the first weight member about the first rotational axis.

20. The clothes treatment apparatus of claim 1, wherein the vibration body comprises a weight casing accommodating the first eccentric portion and the second eccentric portion.

* * * * *